US010556366B2

(12) United States Patent
Fraser

(10) Patent No.: US 10,556,366 B2
(45) Date of Patent: Feb. 11, 2020

(54) VOID FORMER

(71) Applicant: Maurice Andrew Fraser, Auckland (NZ)

(72) Inventor: Maurice Andrew Fraser, Auckland (NZ)

( * ) Notice: Subject to any disclaimer, the term of this patent is extended or adjusted under 35 U.S.C. 154(b) by 0 days.

(21) Appl. No.: 15/780,826

(22) PCT Filed: Dec. 2, 2016

(86) PCT No.: PCT/IB2016/057284
§ 371 (c)(1),
(2) Date: Jun. 1, 2018

(87) PCT Pub. No.: WO2017/093948
PCT Pub. Date: Jun. 8, 2017

(65) Prior Publication Data

US 2018/0361620 A1 Dec. 20, 2018

(30) Foreign Application Priority Data

Dec. 3, 2015 (NZ) ..... 714848

(51) Int. Cl.
*B28B 23/00* (2006.01)
*E02D 29/02* (2006.01)

(52) U.S. Cl.
CPC ..... *B28B 23/0068* (2013.01); *B28B 23/005* (2013.01); *E02D 29/025* (2013.01); *E02D 29/0233* (2013.01); *E02D 29/0266* (2013.01); *E02D 2300/002* (2013.01); *E02D 2600/30* (2013.01)

(58) Field of Classification Search
CPC combination set(s) only.
See application file for complete search history.

(56) References Cited

U.S. PATENT DOCUMENTS 3,172,603 A * 3/1965 Bell ..... E01B 9/14 238/265
3,234,703 A * 2/1966 Sullivan, Jr. ..... F23M 5/06 110/331
4,273,476 A * 6/1981 Kotulla ..... E02D 29/0241 405/284
4,343,571 A 8/1982 Price
5,625,993 A * 5/1997 Kelly ..... E04B 1/4107 52/506.05
5,839,855 A 11/1998 Anderson et al.
6,079,908 A 6/2000 Anderson
6,443,662 B1 * 9/2002 Scales ..... E02D 29/0241 405/262
6,443,663 B1 * 9/2002 Scales ..... E02D 29/0241 405/262
6,468,004 B1 * 10/2002 Price ..... E02D 29/0225 405/262
7,731,455 B2 6/2010 Shin
(Continued)

FOREIGN PATENT DOCUMENTS

KR 101071595 B1 10/2011
KR 101369209 B1 3/2014
WO 2007012864 A1 2/2007

*Primary Examiner* — Kyle Armstrong
(74) *Attorney, Agent, or Firm* — Studebaker & Brackett PC

(57) ABSTRACT

A void former to form a void in an earth retaining cast block during casting, the void configured to locate a strap for a strap stabilised earth structure.

21 Claims, 21 Drawing Sheets

(56) References Cited

U.S. PATENT DOCUMENTS

| | | | | |
|---|---|---|---|---|
| 8,402,701 | B2 * | 3/2013 | Arteon | E04G 21/142 52/125.2 |
| 8,790,045 | B2 * | 7/2014 | Cariou | E02D 29/0225 405/262 |
| 8,985,900 | B2 * | 3/2015 | Freitag | E02D 29/0241 405/107 |
| 9,803,354 | B1 * | 10/2017 | Francies, III | E04B 1/4107 |
| 2006/0171783 | A1 * | 8/2006 | Freitag | E02D 29/0241 405/262 |
| 2007/0039281 | A1 * | 2/2007 | Zambelli | E04B 1/4107 52/710 |
| 2010/0251649 | A1 | 10/2010 | Woolbright | |
| 2011/0000148 | A1 * | 1/2011 | Arteon | B28B 23/005 52/125.5 |
| 2012/0023857 | A1 | 2/2012 | Bergmann | |

* cited by examiner

VOID FORMER

FIELD OF INVENTION

The present invention relates to a void former for forming a void in an earth-retaining cast block wall or face for a stabilised earth structure.

BACKGROUND

The technique of using straps in a reinforced wall structure to stabilise an earth structure is known in the construction industry.

To form an earth retaining wall, multiple concrete blocks are laid upon each other in an adjacent manner. An example block is the Stone Strong block by Stone Strong Systems®. Stone Strong Systems provide a 24 square foot block which is 4 times larger than other available blocks, and can be used to build walls up to about 50 feet in height. A first layer of blocks is laid down, straps are affixed and secured to each respective block and laid back towards and over the earth foundation. Earth is in-filled behind the wall and on top and around the straps. A secondary layer of blocks is laid upon the first layer, a subsequent layer of straps are attached to said blocks of the secondary layer of blocks and laid back towards and over the earth structure. Further earth is in-filled behind the blocks and above each strap layer. Subsequent layers of blocks and straps are added to achieve a required height for the retaining wall. Thus, the completed retaining wall is tied to the earth behind the wall by the straps embedded in the earth being retained by the wall. A known strap product for earth retaining walls is ParaWeb® by Linear Composites.

Aspects of the present invention relate to the way in which a strap is secured to a block. Typically a strap must have its end fitted through a closed loop void within the concrete block. Insertion of the strap can be difficult. In other designs, a void is formed within each concrete block in which a strap may have its end threaded through. This can be cumbersome and time consuming as long lengths of strap must be threaded through the void. Also, the void formers must be very robust to withstand the concrete block pouring and casting process. In some designs, a particularly secure engagement between the pin and the block may be desirable, such that the pin does not move relative to the block so that the transfer of force from the strap to the block is achieved in an efficient and/or effective manner. Further, many void formers may be required and shipping and storing of void formers can require significant container volume.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

For the purposes of this specification, the term "plastic" shall be construed to mean a general term for a wide range of synthetic or semisynthetic polymerization products, and generally consisting of a hydrocarbon-based polymer.

For the purpose of this specification, where method steps are described in sequence, the sequence does not necessarily mean that the steps are to be chronologically ordered in that sequence, unless there is no other logical manner of interpreting the sequence.

OBJECT OF INVENTION

It is an object of the present invention to provide a void former which overcomes or at least partially ameliorates some of the abovementioned disadvantages or which at least provides the public with a useful choice.

SUMMARY OF THE INVENTION

In one aspect, the present invention consists in a void former to form a void in an earth retaining cast block to locate a strap for a strap stabilised earth structure, the void former forming a void during casting intermediate a first face of the block and a second face of the block, the void former comprising:

- a tail section comprising a first part and a second part, each having complementary features to allow the first and second parts to be secured together to form a conduit configured to operationally accept a strap from a first end of the tail section, and
- a head section configured to secure to a second end of the tail section and form a recess to operationally accept a loop of the strap extending from the tail section and a locking pin to extend through the loop to prevent the strap from being able to pull back through the void former, and
- wherein the first and second parts are configured to be stacked in a flat and/or nested configuration, atop or below one another, when not fitted together to form the conduit.

In some embodiments, the first and second parts are substantially identical.

In some embodiments, the head section is configured to be stacked in a flat configuration when in a non-operational configuration, atop or below another said head section.

In some embodiments, the head section comprises two head section parts, the first and second head section parts configured to be stacked in a flat and/or nested configuration, atop or below one another, when not fitted together to form the conduit.

In some embodiments, the first and second head section parts are substantially identical.

In some embodiments, the strap is composed of polymeric material.

In some embodiments, the pin is composed of glass, fibre glass or metal.

In some embodiments, the pin is an elongate member, for example a rod. The pin may have a circular cross section.

In some embodiments, the void former is composed of plastics.

In some embodiments, the void former is composed of fibreglass.

In some embodiments, a majority of the void former is left in the void after the moulding process.

In some embodiments, the void former comprises an end cap for the head section to prevent ingress of concrete into the void during the casting process.

In some embodiments, the end cap is integrally formed with the head section.

In some embodiments, the head section comprises two sides and the end cap, the two sides foldable with the end cap from a flat configuration to form the recess to accept the locking pin.

In some embodiments, the head section comprises one or more hinges to hinge the end cap to the two sides.

In some embodiments, the end cap is separate to the sides of the head section.

In some embodiments, the end cap is removed from the head section prior to insertion of the pin and/or strap.

In some embodiments, the head section is shaped symmetrically about 2 perpendicular axes but for fastening details for securing two sides of the head section together.

In some embodiments, the head section is shaped symmetrically about 1 axis but for fastening details for securing two sides of the head section together.

In some embodiments, the sides of the head section are separate from each other and the end cap, and are mirror images of one another but for fastening details for securing two sides of the head section together.

In some embodiments, the end cap comprises features to fit and locate the head section in complementary features of an internal mould wall in which the block is cast.

In some embodiments, the fastening details are located about the periphery of the head section.

In some embodiments, the fastening details attach the sides of the head section together.

In some embodiments, the fastening details comprise a barb and hole type arrangement, a barb provided on one of the sides of the head section and a corresponding hole for receiving the barb on the other one of the sides of the head section.

In some embodiments, the fastening means are an expanding U shape and hole type arrangement, a resilient U shaped member provided on one of the sides of the head section and a corresponding hole for receiving the U shaped member on the other one of the sides of the head section.

In some embodiments, the head section comprises two side parts, and each side part of the head section comprises a cut-out, when the two side parts of the head section are fastened together the cut outs forming an orifice to communicate with the conduit allowing access into the recess formed by the head section.

In some embodiments, the head section comprises a raised rim around the orifice, and the tail section comprises a complementary raised rim about an exit of the conduit, the raised rims of the orifice and the exit adapted to fit together to form a substantially concrete-tight seal.

In some embodiments, the head section comprises two side parts that fit together to receive the pin, and the two side parts are substantially parallel to each other in use so as to form a head section with symmetry about a plane extending between the side parts but for fastening details for securing two side parts of the head section together.

In some embodiments, the tail section provides a straight conduit, and the head section comprises a conduit with a turn-back section so that the head section and tail section form a U shape void former, so that in operation the first and second faces are able to be substantially on one face of the block.

In some embodiments, the tail section is straight and the head section comprises a conduit with a bend so that the strap extends substantially horizontally from the tail section at the first face of the block and with the pin located at the second face of the block, the second face at an angle to the first face.

In some embodiments, the void former is configured to have the first end of the tail section at a rearward face of the block and, with the tail section arranged substantially horizontally, the head section at an upward facing face of the block to locate the locking pin at the upward facing face of the block.

In some embodiments, the bend comprises an angle of about 90 degrees.

In some embodiments, the first and second part each comprise a jaw, so that the tail section comprises jaws at the second end of the tail section for receiving the head section, the jaws covering an orifice of the head section for receiving the strap from the tail section, the jaws and the head section together forming the recess for receiving the pin.

In another aspect, the present invention consists in a void former to form a void in an earth retaining cast block to locate a strap for a strap stabilised earth structure, the void former comprising:

a tail section and a head section, the tail section forming a conduit to operationally accept a strap from a first end of the tail section, the head section configured to secure to a second end of the tail section and comprises an orifice, the tail section comprising jaws at the second end of the tail section configured to secure to the head section and cover the orifice, the jaws and the head section together forming a recess to operationally accept a loop of the strap extending from the tail section and a locking pin to extend through the loop to prevent the strap from being able to pull back through the void former.

In some embodiments, the head section and tail section together provide a labyrinth seal about the orifice to form a substantially concrete tight seal about the orifice.

In some embodiments, the head section comprises a raised rim around the orifice, and the tail section comprises a complementary raised rim about an exit of the conduit, the raised rims of the head section and the tail section adapted to fit together to form the substantially concrete-tight seal.

In some embodiments, the head section and tail section comprise a fastening detail to secure the head section and tail section together, the fastening detail including one or more selected from a clip, barb and snap fit engagement.

In another aspect, the present invention consists in a system for forming a void in an earth retaining cast block to locate a strap for a strap stabilised earth structure, the system adapted to form different shaped voids during casting intermediate a first face of the block and a second face of the block, the system comprising:

a tail section to form a conduit configured to operationally accept a strap from a first end of the tail section, a plurality of head sections each configured to optionally secure to a second end of the tail section and form a recess to operationally accept a loop of the strap extending from the tail section and a locking pin to extend through the loop to prevent the strap from being able to pull back through the void former, and wherein each of the head sections is shaped and configured to form the recess for receiving the pin at different locations in the block.

In some embodiments, the tail section provides a straight conduit, and the head section comprises a conduit with a turn-back section so that the head section and tail section form a U shape void former, so that in operation the first and second faces are able to be substantially on one face of the block.

In some embodiments, the tail section provides a straight conduit and the head section comprises a conduit with a bend so that the strap extends substantially horizontally from the tail section at the first face of the block and with the pin located at the second face of the block, the second face at an angle to the first face.

In some embodiments, the void former is configured to have the first end of the tail section at a rearward face of the block and, with the tail section arranged substantially horizontally, the head section at an upward facing face of the block to locate the locking pin at the upward facing face of the block.

In some embodiments, the bend comprises an angle of about 90 degrees.

In another aspect, the present invention consists in a void former to form a void in an earth retaining cast block to locate a strap for a strap stabilised earth structure, the void former forming a void during casting intermediate a first face of the block and a second face of the block, the void former comprising:

a conduit section configured to operationally accept a strap from a first end of the conduit section, and a head section at a second end of the conduit section configured to form a recess to operationally accept a loop of the strap extending from the conduit section and a locking pin to extend through the loop to prevent the strap from being able to pull back through the void former, wherein the conduit section comprises a bend, so that the strap extends substantially horizontally from the conduit section at the first face of the block and with the pin located at the second face of the block, the second face at an angle to the first face.

In some embodiments, the void former is configured to have the first end of the conduit section arranged substantially horizontally at a rearward face of the block and the head section at an upward facing face of the block to locate the locking pin at the upward facing face of the block.

In some embodiments, the bend comprises an angle of about 90 degrees. In some embodiments the angle between the first face and the second face of the block is 90 degrees.

In some embodiments, the upwardly facing face is perpendicular to the rear face.

In another aspect, the present invention consists in a void former to form a void in an earth retaining cast block to locate a strap for a strap stabilised earth structure, the void former comprising:

a tail section comprising a first part and a second part, each having complementary features to allow the first and second parts to be secured together to form a conduit configured to operationally accept a strap from a first end of the tail section, and a head section comprising a first part and a second part, each having complementary features to allow the first and second parts to be secured together to form a recess to operationally accept a loop of the strap extending from the tail section and a locking pin to extend through the loop to prevent the strap from being able to pull back through the void former, and an end cap to prevent ingress of concrete into the void former during the casting process, wherein the first part and second part of the tail section, the first part and second part of the head section, and the cap, are integrally formed, the void former comprising one or more hinges to hinge the end cap to the first and second parts of the head section so that the void former is foldable from a flat configuration to a form the recess and conduit.

In another aspect, the present invention consists in a void former adapted to form a void in an earth retaining cast block to locate a strap for a strap stabilised earth structure, the void former comprising:

a tail section and a head section attached to or integrally formed with the tail section, the tail section forming a conduit configured to operationally accept a strap from a first end, and the head section forming a recess at a second end of the tail section to operationally accept a loop of the strap extending from the second end of the tail section and a locking pin to extend through the loop to prevent the strap from being able to pull back through the void former, the recess comprising a gap between the pin and the head section for the loop of the strap to locate about a circumference of the pin, and wherein the head section is adapted to receive the pin with ends of the pin extending from sides of the head section to be embedded directly in material forming the cast block.

In some embodiments, the head section comprises a first aperture at a first side and a second aperture at a second side, in use ends of the pin extending from the first and second apertures to be embedded directly in material forming the cast block.

In some embodiments, each of the first and second sides of the head section forms a seal about a circumference of the pin to limit or prevent egress of material of the cast block entering the void during a casting process when casting the block.

In some embodiments, the head section comprises a first tubular portion at the first side of the block and a second tubular portion at the second side of the block, the first and second tubular portions forming the first and second apertures, each of the first and second tubular portions forming the seal.

In some embodiments, the head section comprises a first part and a second part, and when assembled the first and second parts clamp or surround the pin so that each side of the head section forms a seal about a circumference of the pin to limit or prevent egress of material of the cast block entering the void during a casting process when casting the block.

In some embodiments, the head section is attached to the tail section and the tail section holds the first and second parts together.

In some embodiments, the head section comprises an orifice, the tail section comprising jaws at the second end of the tail section configured to secure to the head section and cover the orifice, the jaws receiving the head section to hold the two part together, the jaws covering the orifice so that the jaws and the head section together form the recess.

In some embodiments, the two parts are hinged together.

In some embodiments, the tail section comprises a first part and a second part, the first part of the head section and the first part of the tail section integrally formed, and the second part of the head section and the second part of the tail section integrally formed, so that the former comprises a first former part and a second former part adapted to be assembled together about a said pin so that the pin is received in the head section and with ends of the pin extending from the head section.

In some embodiments, the first and second former parts are hinged or joined together about a hinge axis, the two former parts adapted to be assembled together by folding about the hinge axis.

In another aspect, the present invention consists in a cast block comprising one or more voids formed by a void former or a system for forming a void as described in any one or more of the above statements. In some embodiments, the block comprises at least 4 voids, or at least 6 voids, or at least 8 voids. In some embodiments, the block is cast from concrete.

In another aspect, the present invention consists in a retaining wall comprising a cast block as described in the preceding paragraph.

In another aspect, the present invention consists in a method of building a retaining wall comprising the steps:

a) laying a course or row of blocks, the blocks as described above,
b) folding a strap to form a bight or loop and threading the bight or loop into the void former from the first end of the tail section or conduit section of the void former to position the bight or loop in the head section of the void former,
c) inserting a pin through the bight or loop,
d) pulling the strap back to secure the strap around the pin in the recess,
e) laying the strap extending from the block across earth behind the wall,
f) repeating steps b) to e) to secure straps in other void formers of the course or row of blocks,
g) back filling and compacting earth over the straps extending from the course or row of blocks to the height of the course or row of blocks,
h) repeating steps a) to g) for subsequent courses or rows of said blocks on top of a previous course or row of blocks to achieve a desired wall height.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term 'pin' as used in this specification and claims, unless the context suggests otherwise, is intended to broadly mean an elongate member, including an elongate member with a length many times is width or diameter, for example a length of reinforcing bar to be embedded in a concrete block or element.

The term 'block' as used in this specification and claims, unless the context suggests otherwise, is intended to broadly mean a 3-dimensional body or member or element of any particular shape and is not intended to be limited to a cuboid.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION OF THE INVENTION

Figure 1:
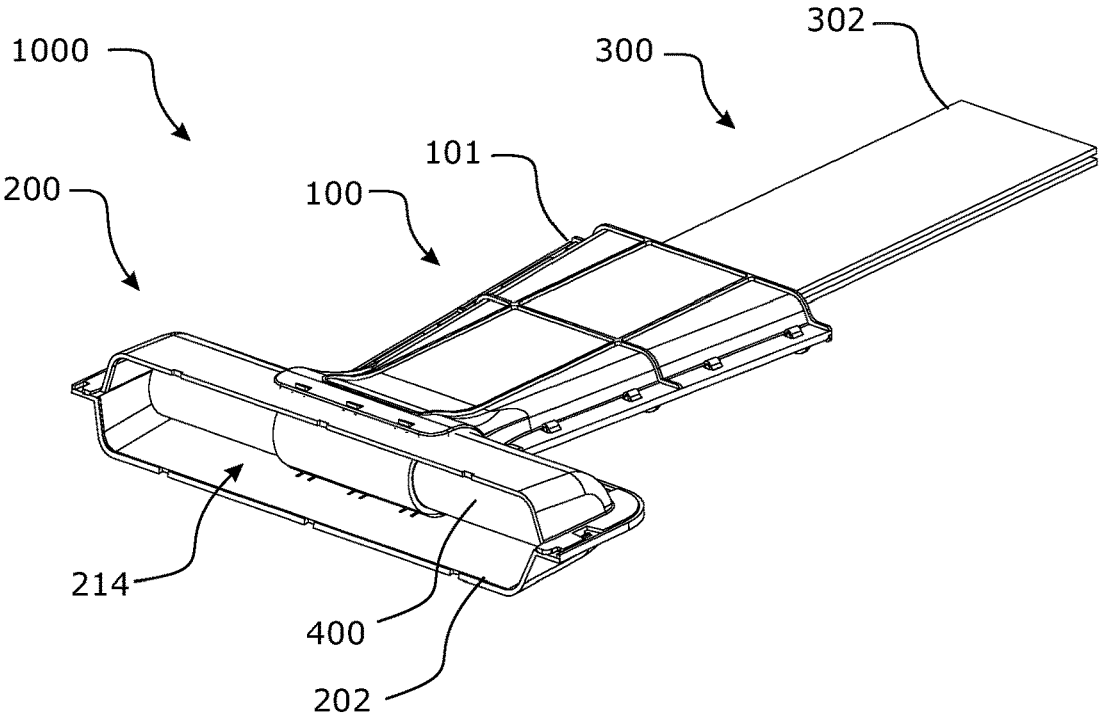
FIG. 1 shows a top perspective of a void former, strap and pin.
Figure 2:
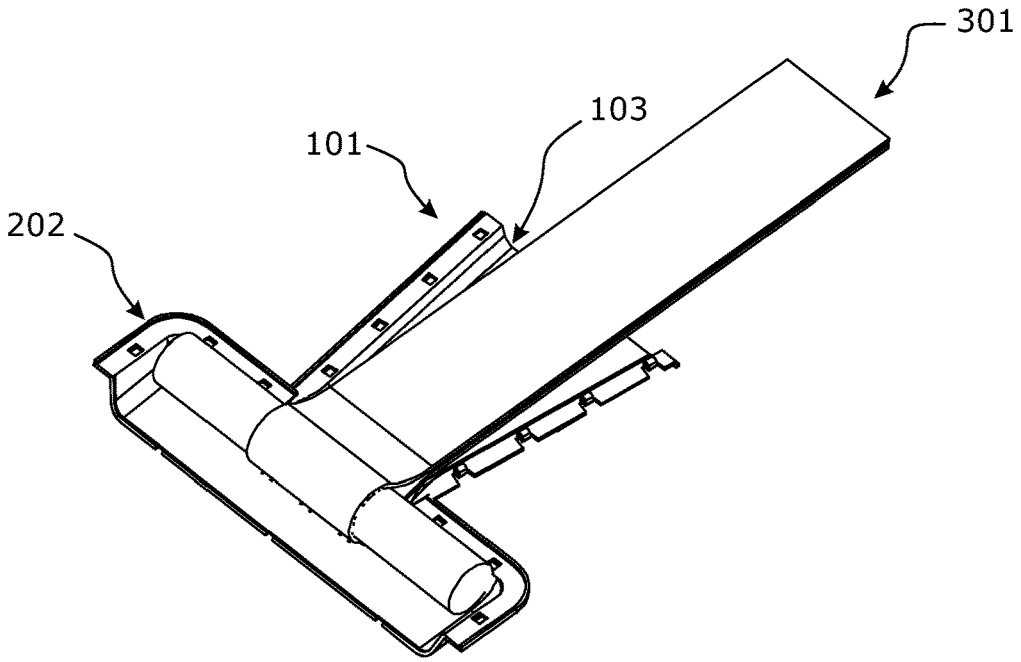
FIG. 2 shows a partially disassembled top perspective view of a void former, strap and pin.
Figure 3:
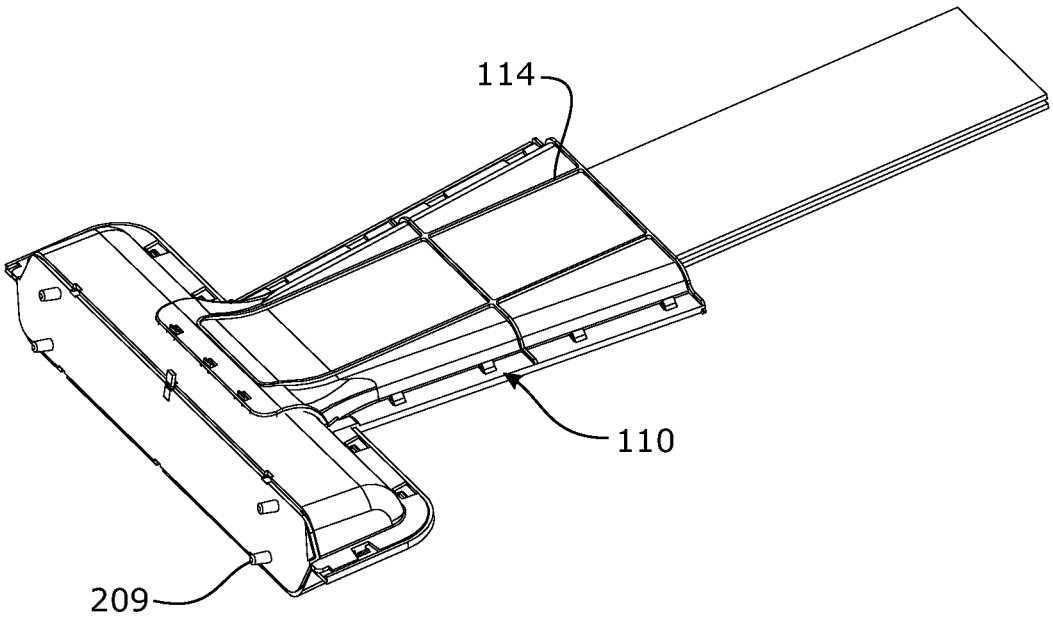
FIG. 3 shows a top perspective view of a void former with an end cap.
Figure 4:
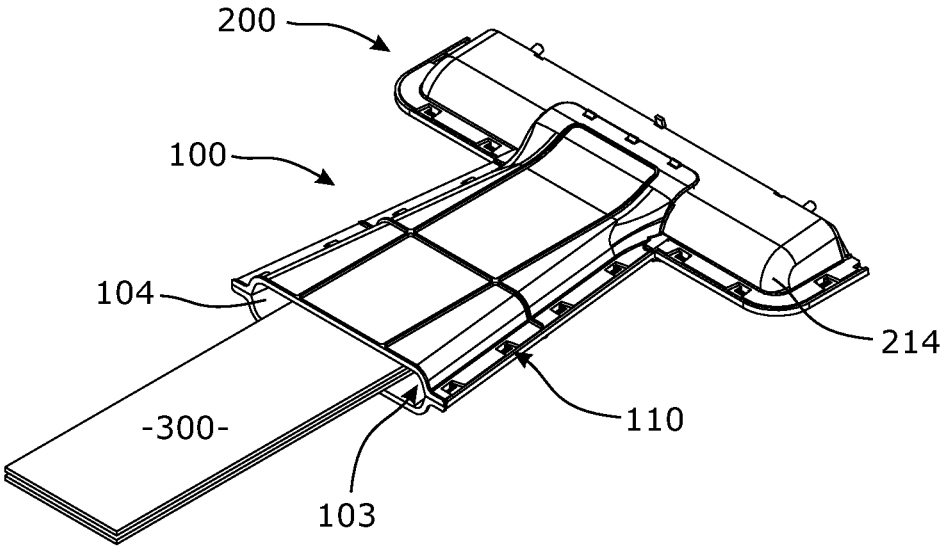
FIG. 4 shows a rear perspective view of FIG. 3.

With reference to the above drawings, in which similar features are generally indicated by similar numerals, a void former according to a first aspect of the invention is generally indicated by the numeral 1000.

In one embodiment now described, there is provided a void former for forming a void in an earth retaining cast block to locate a strap for a strap stabilised earth structure. In one example used throughout this specification, the cast blocks are adapted to form a wall to retain earth. The blocks are used to build a wall and are back-filled, for example with granular soil. Straps are secured to the blocks. The straps are retained within the backfill soil. The blocks and the straps secured to the blocks and retained in the backfill form the reinforced wall.

The straps 300 are preferably composed of a polymeric material. Composition straps are used in the industry and are considered to be able to be used with the present invention. A typical strap used is known by the trade name ParaWeb®. The straps 300 are secured to a cast block 500 having a rear face 502 facing the in-fill and a forward facing face 503 facing away from the in-fill. The block 500 comprises a void 501 through which the strap may be passed through. The void provides a means by which the strap is secured to the block, and also provides a insulating or protection layer between the strap and the concrete block so that the strap does not make contact with the block material which may degrade the strap material over time.

The void is formed by a void former 1000 of one embodiment of the present invention. The void former 1000 consists of a tail section 100 to be oriented nearest the rear face 502, and a head section 200. The tail section 100 has an entry (opening) 104 through which the strap 300 may pass through from the rear face 502 into the void former. The tail section has a subsequent exit 105 in which the strap 300 passes through into the head section 200. Intermediate the entry 104 and exit 105 the tail section provides or forms a conduit 103. The head section comprises a region or recess 214 to receive and house a pin 400 within the block. The tail section forms a substantially horizontal portion of the void in the block, so that in use the strap extends substantially horizontally from the void from a rear face of the block.

In use, the strap 300 is passed through the void 501 formed by the void former 1000 from the rear face 502 of the block 500. In some embodiments the strap 300 is passed through the conduit 103 of the void to the forward facing face 503 of the block. The forward facing face of the block may be a front face of the block or other forward facing surface of the block, for example surface 505 shown in FIG. 12. Once the strap has passed through to the forward facing face 503, a pin 400 is inserted through a loop 301 of the strap. The looped strap may then be pulled back towards the entrance 104 of the tail section to secure the strap to the block 500 via the pin 400. The head section is broader and/or deeper than the exit 105 of the tail section so that the void former presents a bearing surface against which the pin 400 bears once the pin is pulled towards the rear face of the block by the strap looped around the pin and passing through the tail section of the former. The loop 301 may be integrally formed with the strap or in preferred embodiments the loop 301 may be a bight of a strap that has been doubled back upon itself. In a preferred method, a loop or bight is formed in the strap by folding the strap over onto itself, the folded end forming the loop inserted and passed through the void to receive the pin 400.

The strap ends 302 are pulled tight, or are not loose, to pull the strap loop 301 and respective pin 400 into the forward facing face of the block. In some embodiments multiple straps may be secured to a single block. Typically a block is provided with multiple voids, with a strap looped through each void. In some installations more than one strap may be looped through a single void. The process of securing a strap to the block is repeated for the loops or bights of strap into each respective void 501 of a block. Once all straps have been entered into their respective voids 501 on a horizontal plane, the earth is yet again in-filled on top of the straps 300 to the horizontal plane of a second array of voids 501. The process is then repeated again. It is envisage voids 501 may be located at multiple planes on one block to equally restrain the block.

Any tension on the strap ends 302 will pull the strap loop 301 and respective pin 400 towards the front or forward facing face 503 of the block 500, preventing the strap 300 from pulling through the void 501.

Cast Block

Figure 16:
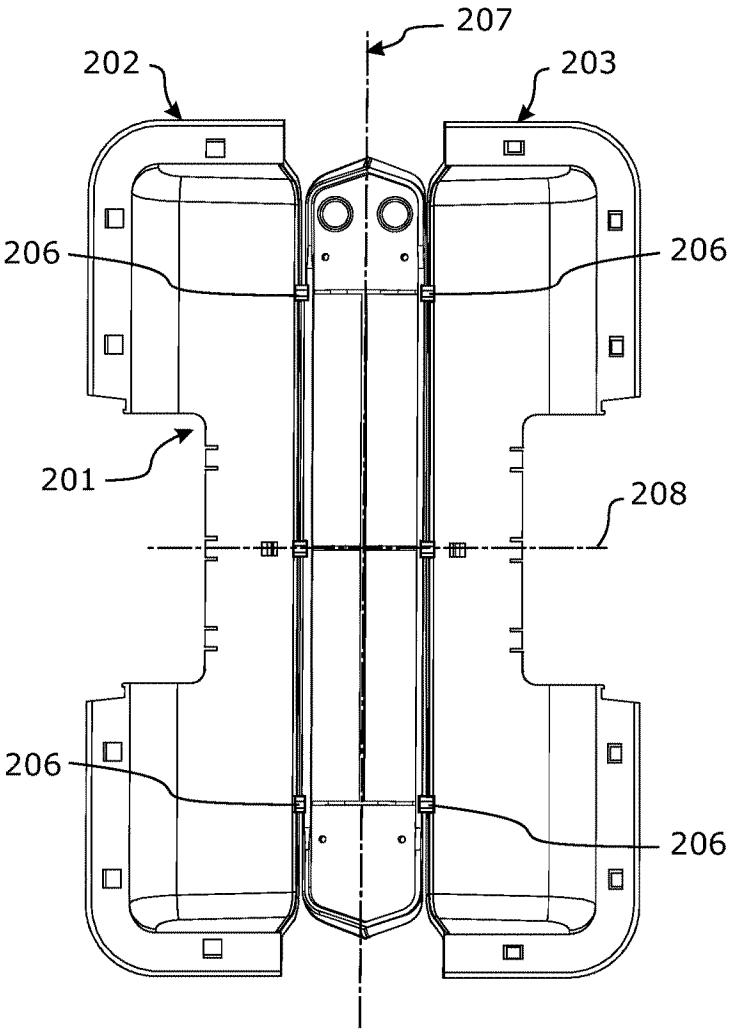
FIG. 16 shows a top view of a head section and in Folded out.
Figure 19:
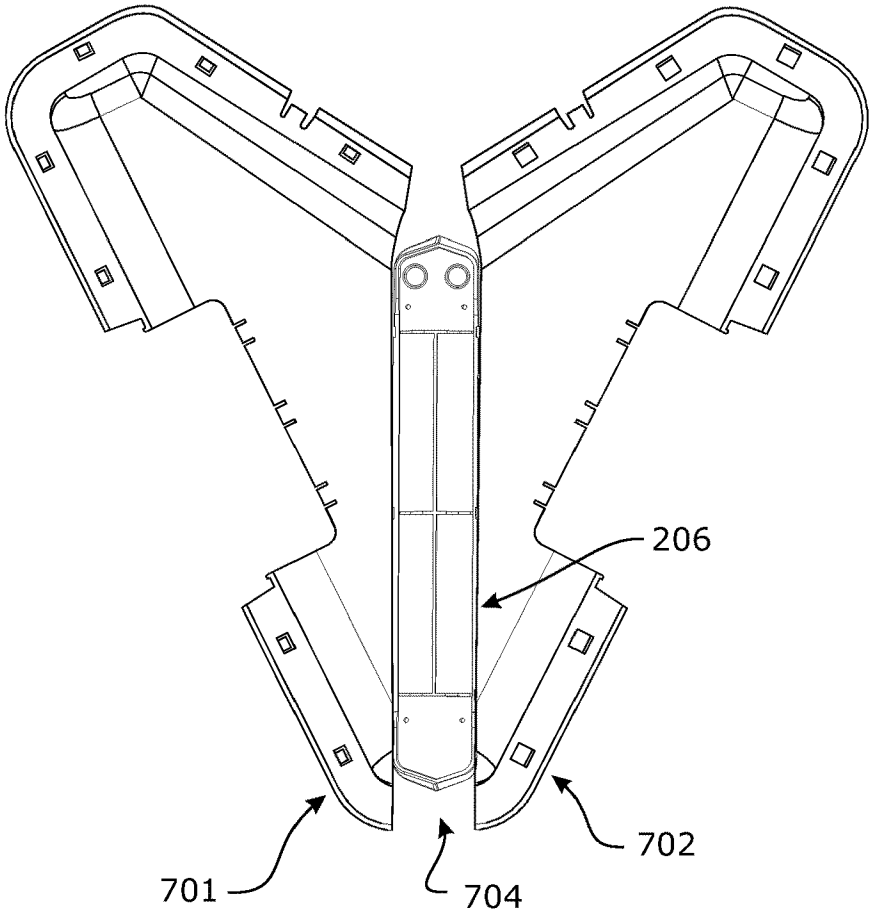
FIG. 19 shows a top view of a further alternative angled head section bothered out with an end cap.

The cast block 500 is preferably composed of concrete. The cast block is formed in a mould (not shown). The mould may comprise 'doors' that fold inwards to create hollow sections in the block. The void formers 1000 are placed within the mould and secured, for example in the following way. The head section 200 is located and directed downwards towards an inner wall of the mould. The head section 200 comprises an end cap 204 which secures and abuts itself against an inner wall of the mould. The end cap 204 may comprise protrusions 209, which fit into complementary holes in the mould walls (not shown), to locate the void former in a cavity of the mould. Other attachment arrangements to attach the void to the mould wall may be used. For example a threaded fastener(s) may be used to fix the void former via the cap 204 to the wall of the mould. Preferably the cap has a rib extending from an inside surface around the perimeter of the cap to provide stiffness to the cap. The perimeter rib 216 is shown in FIG. 16.

In alternative embodiments the head section does not comprise an end cap, instead the head section is slotted into grooves in the mould wall. Alternatively the entire head section may plug a hole in the mould wall. It is envisaged that many alternatives are possible to secure the void former to the mould.

Figure 11:
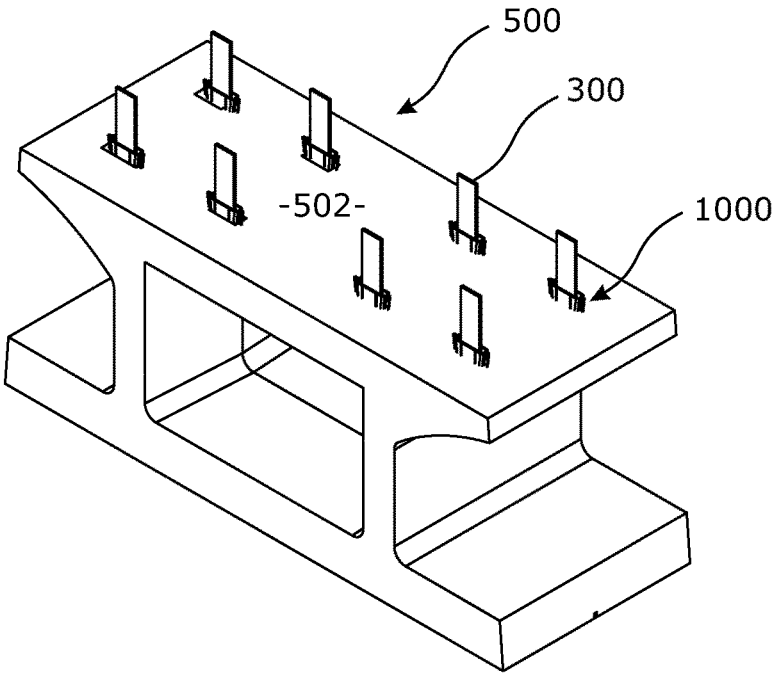
FIG. 11 show a side perspective view of a block in the position of casting with void former is formed into the block.

A finished cast block is shown in FIG. 11, as an example, cut-off straps have been included within the void formers 1000.

The tail section 100 protrudes upwards from the rear face 215 of the head section towards the top of the mould where the concrete is poured from during the casting process. The tail section 100 extends beyond the top of the pour level of the concrete in the mould so concrete cannot generally flow into the void formed by the void former.

Figure 22:
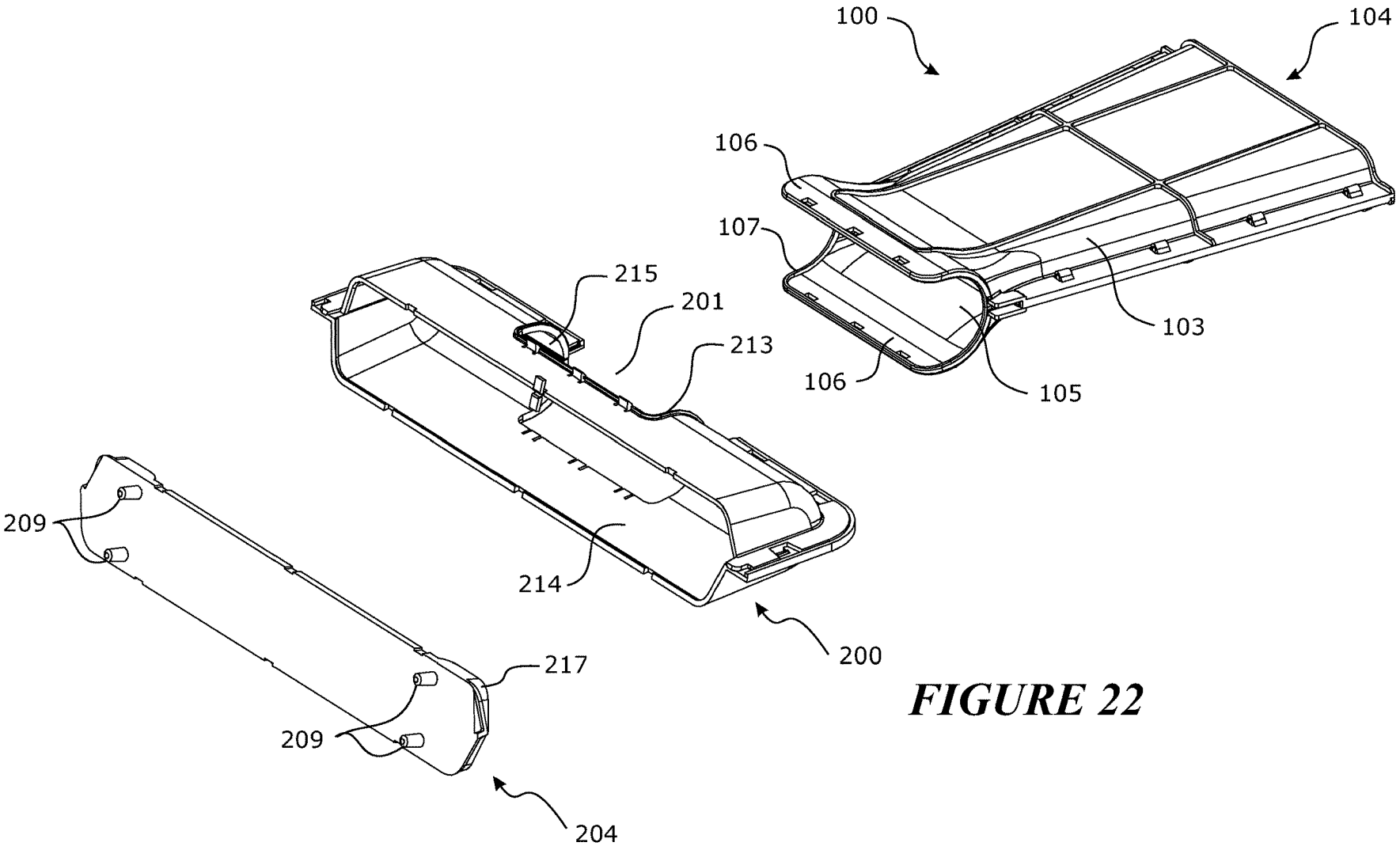
FIG. 22 shows a front perspective view of a void former with separated head section, tail section and end cap.
Figure 23:
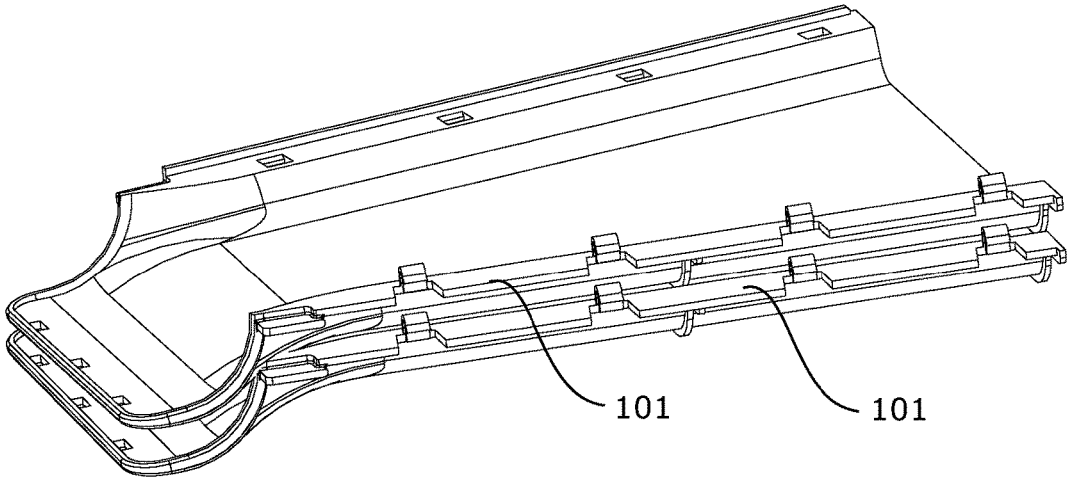
FIG. 23 shows a tail section part of the void former nested together in a flat packed configuration with other tail section parts.
Figure 24:
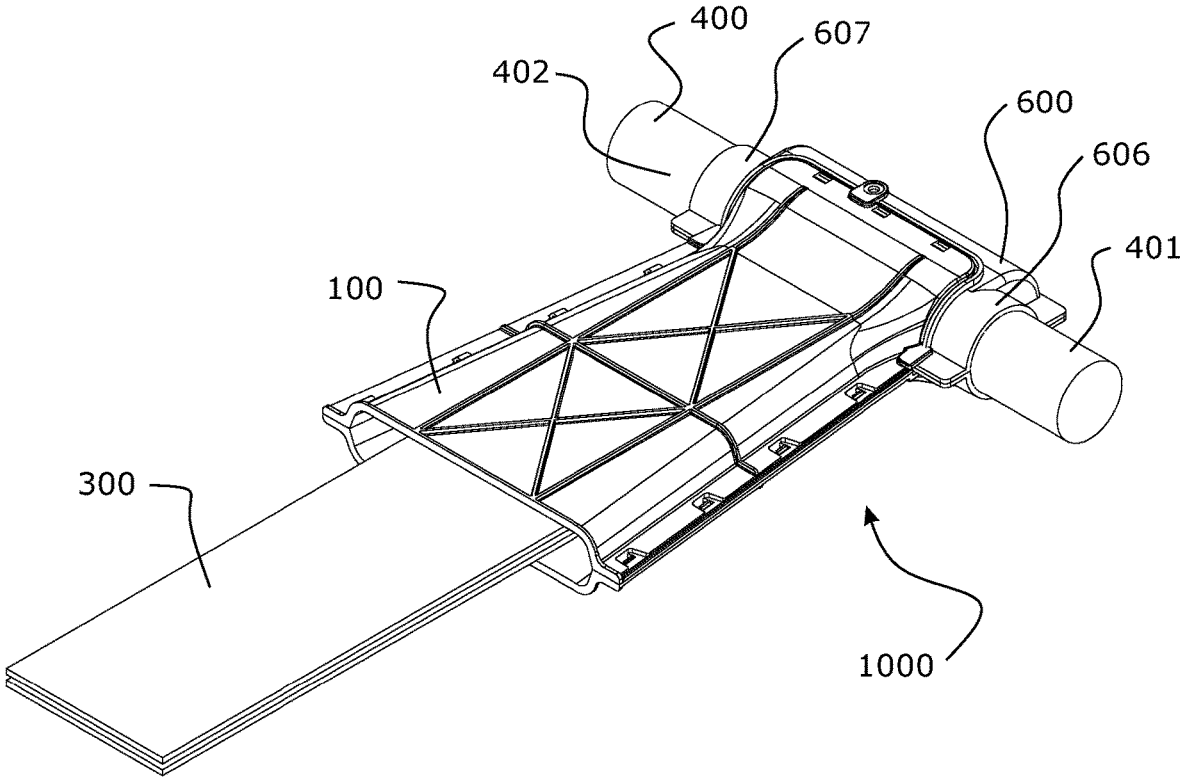
FIG. 24 shows a top perspective of a void former, strap and pin from a first end of the former.
Figure 25:
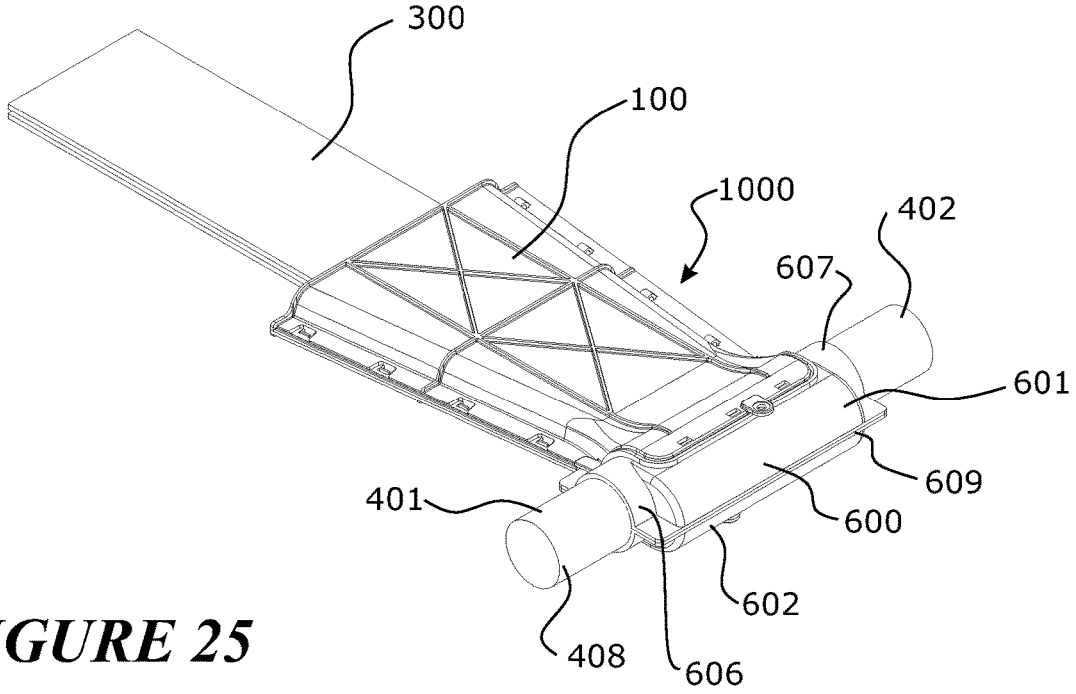
FIG. 25 shows a top perspective of the void former, strap and pin of FIG. 24 from a second end of the former.
Figure 26:
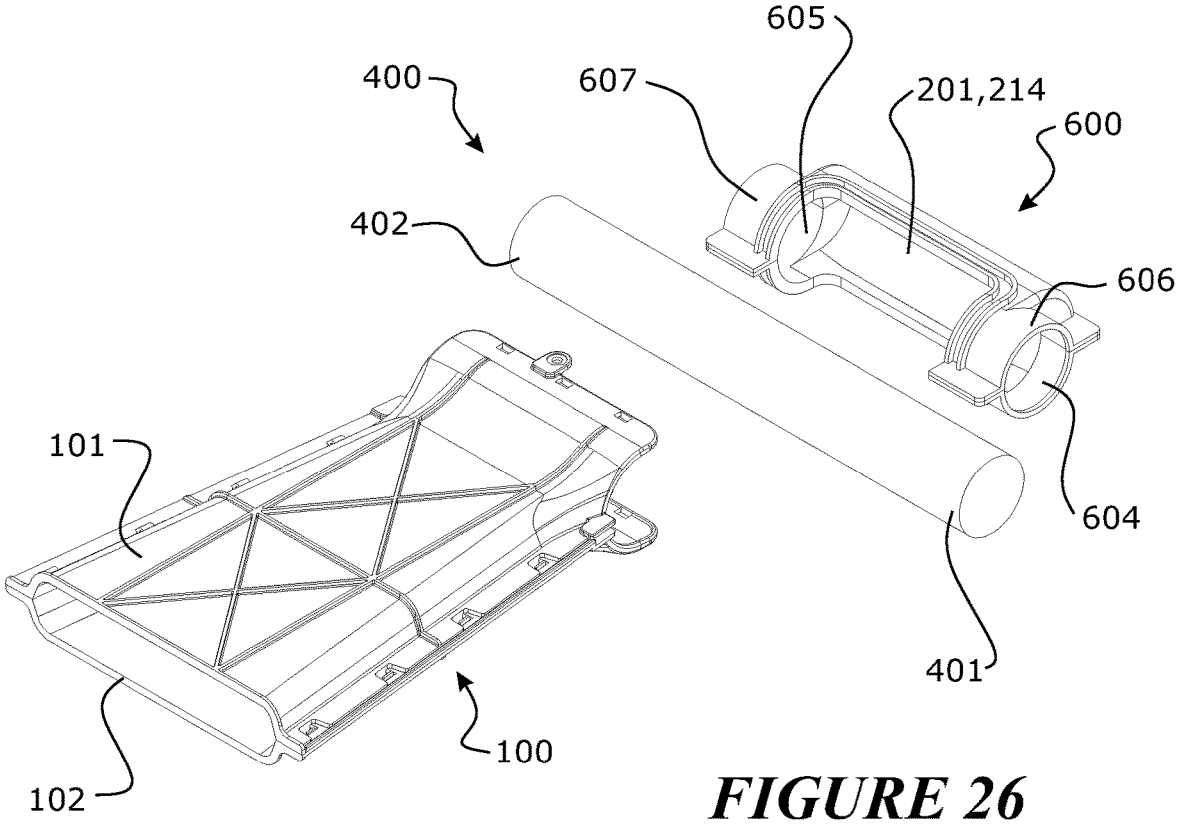
FIG. 26 shows a partially disassembled top perspective view of the void former and pin of FIG. 24 from a first end of the former.
Figure 27:
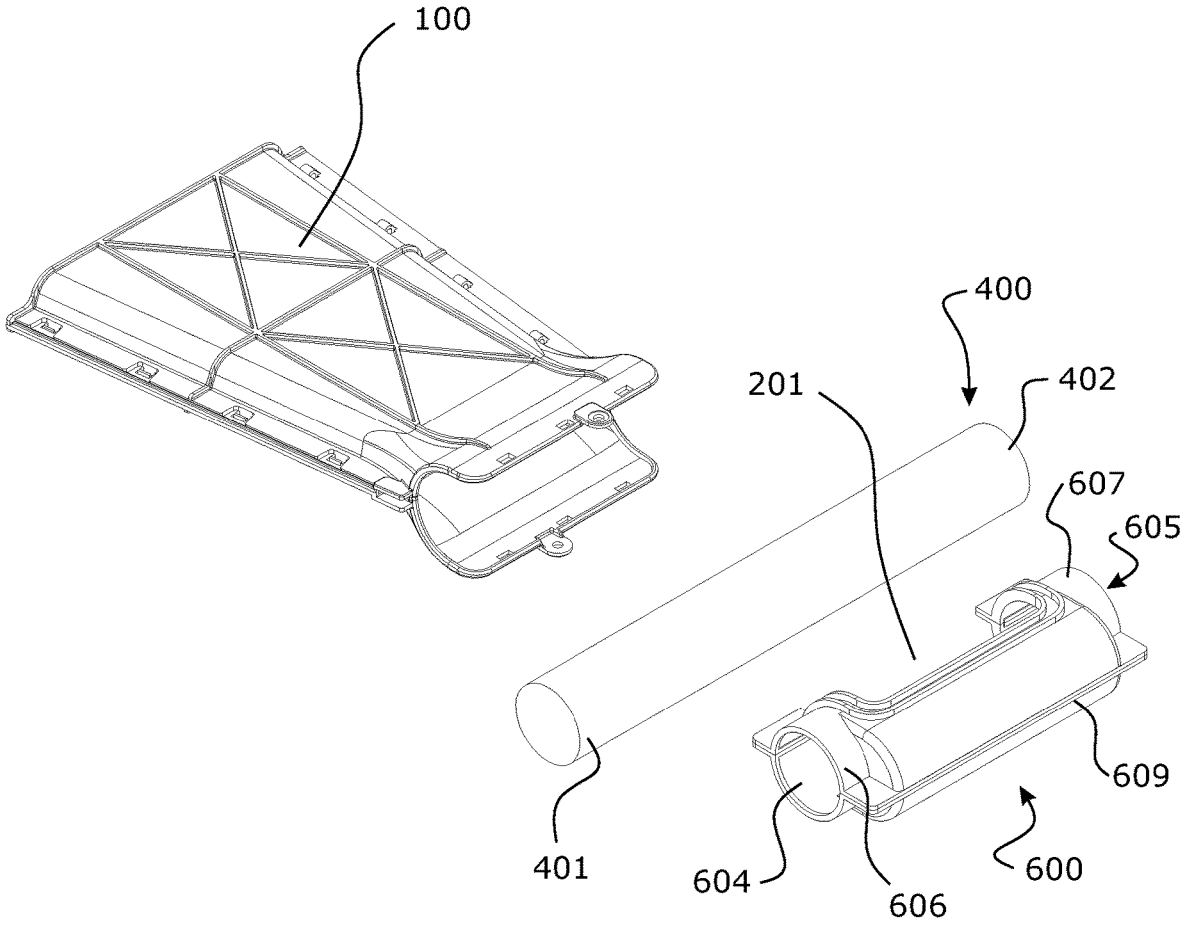
FIG. 27 shows a partially disassembled top perspective view of a void former and pin of FIG. 24 from a second end of the former.
Figure 28:
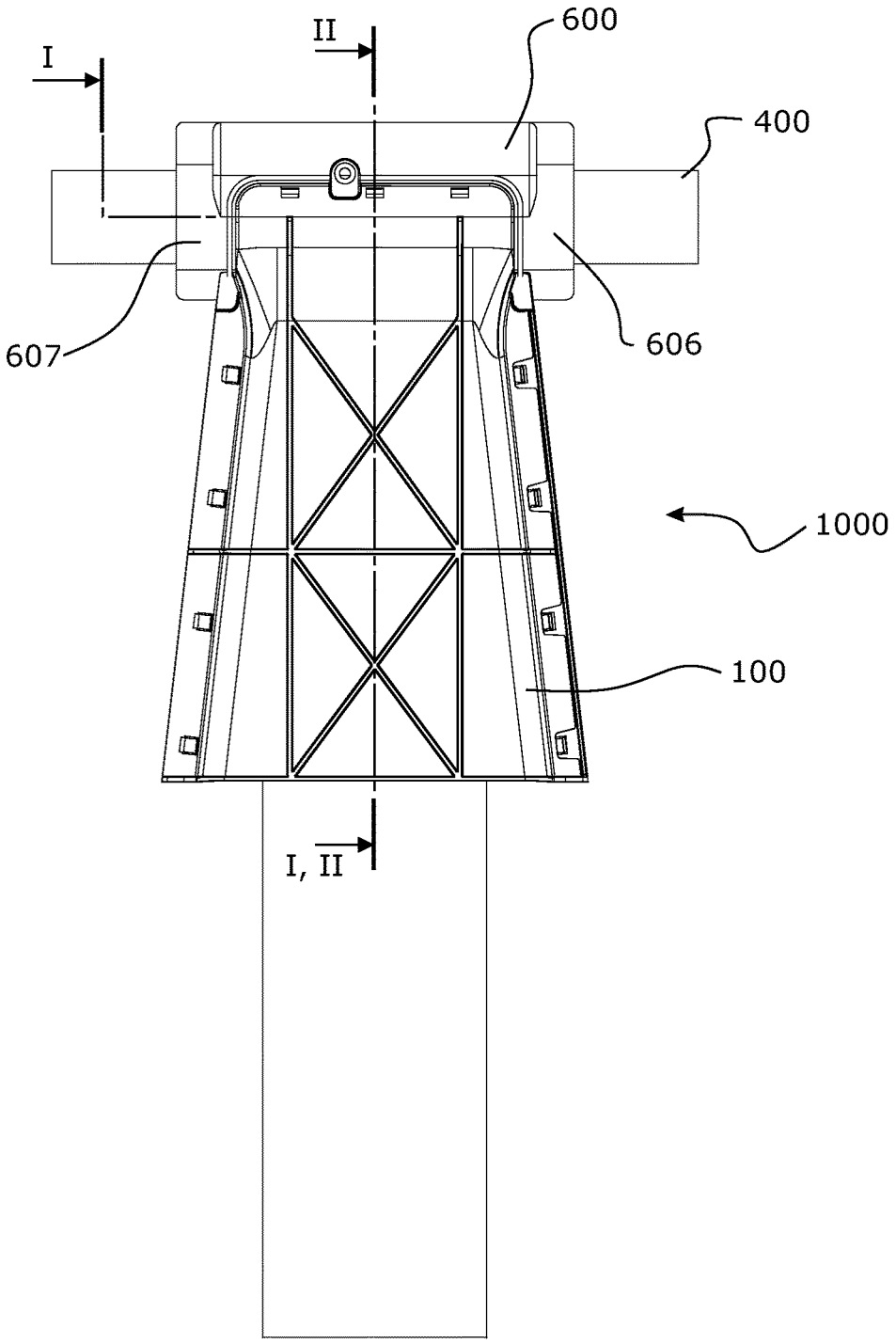
FIG. 28 shows a top view of the former, strap and pin of FIG. 24.

During casting, concrete is poured into the mould and flows about the mould walls and void formers 1000. The end cap 204 prevents ingress of concrete into the volume formed by the void former. The end cap may also support side walls of the former from collapsing or bending inwards under weight of the concrete poured into the mould. For example, end cap 204 may include a perimeter wall 217 (FIG. 22) that supports walls or sides of the head component 200 from an inside of the head component, to hold against the walls of the head component from flexing inwards at the opening of the head component through which the pin 400 is received. Concrete does not enter the end of the tail section 100 due to the tail section extending above the pour line of the concrete. In some embodiments, the tail section 100 may comprise a cap or plug (not shown), to cover the entrance opening 104, that is temporarily introduced into the end of each tail section to prevent ingress of concrete or other detritus. In alternative embodiments the cap or plug is integral with the tail section, similar in design to the end cap 204 described below.

During or after pouring concrete into the mould and before the concrete has set the mould may be vibrated to assist with filling the mould to ensure no unintended voids exist in the cast block.

Once the cast block has at least partially cured, it is removed from the mould. For example, doors of the mould may be opened, to remove the block from the mould. As the doors are opened or as the block is removed from the mould the protrusions 209 fitted into holes in the surface of the mould may be sheared off. The protrusions 209 remaining in the holes of the mould wall may be removed later so that a new former may be fitted for a further moulding process. The end cap 204 may then be removed from the head section of the void former 1000. The end cap can be removed by smashing out the end cap or the end cap may be clipped off the head section 200. In a preferred embodiment, the end cap is joined to a first part and a second part of the head section of the void by resilient hinges that are able to be broken off to remove the end cap. Such an arrangement is described below.

Figure 12:
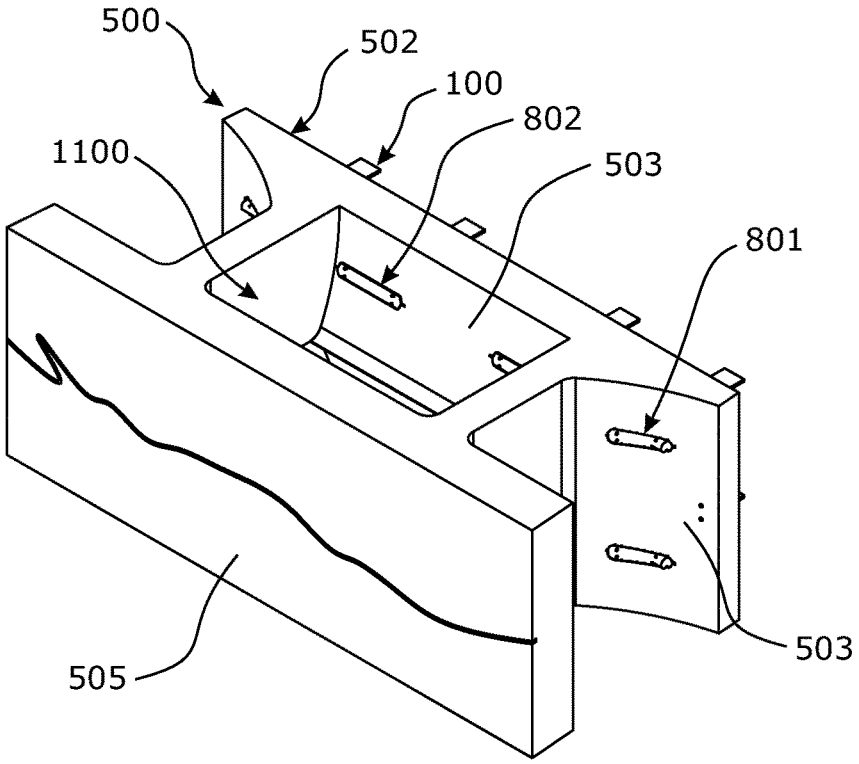
FIG. 12 shows a front perspective view of a block and an operational position.
Figure 13:
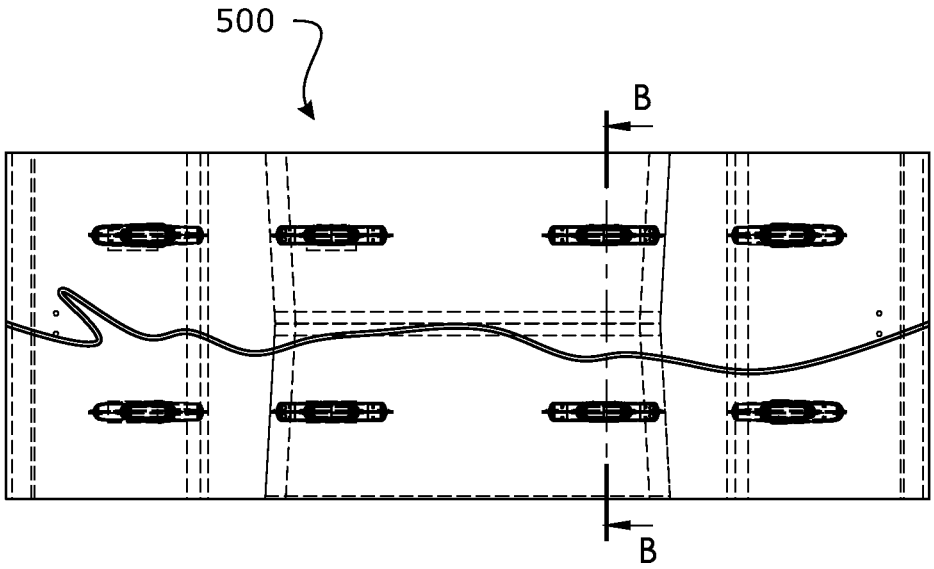
FIG. 13 shows a front view of FIG. 12.
Figure 14:
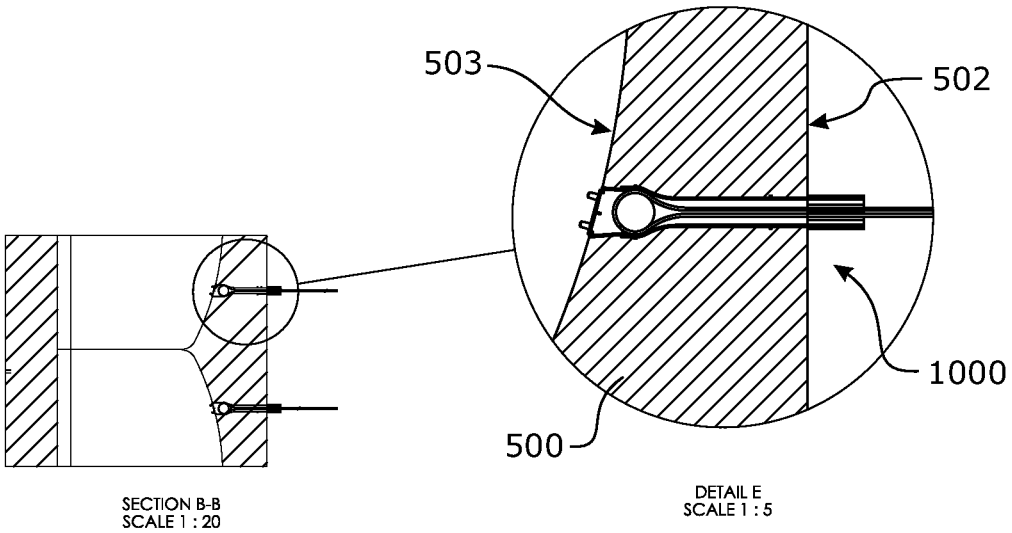
FIG. 14 shows cross section B-B and detail showing a side cross section of a former in use.

Preferably, the block 500 has multiple voids 501 as shown in FIGS. 11 to 13. In one embodiment, the block has two voids, or between four and six voids. In some embodiments, the block has eight voids.

It is envisaged that the block 500 does not necessarily have hollowed sections providing a forward facing face 503 intermediate the rear face 502 and the wall front face 505. The block may be solid the whole way through, in which case in some embodiments the void former 1000 extends from the rear face 502 to the front face 505 of the block. A void former according to some embodiments of the present invention may be used in solid panels used to form a retaining wall structure, and in this specification and claims, 'block' is intended to mean any block like building element including thick panels, unless the context suggests otherwise. In the illustrated examples the blocks generally have a rectangular outer block shape (or envelope), wherein the width of the block is greater than the height and depth of the block, and the depth of the block is greater than the height of the block. However, the blocks may be other useful shapes, for example cubic. Stone Strong Systems® provide blocks that are triangular in plan view, which also may be used together with the embodiments of the present invention.

Jaws

Figure 5:
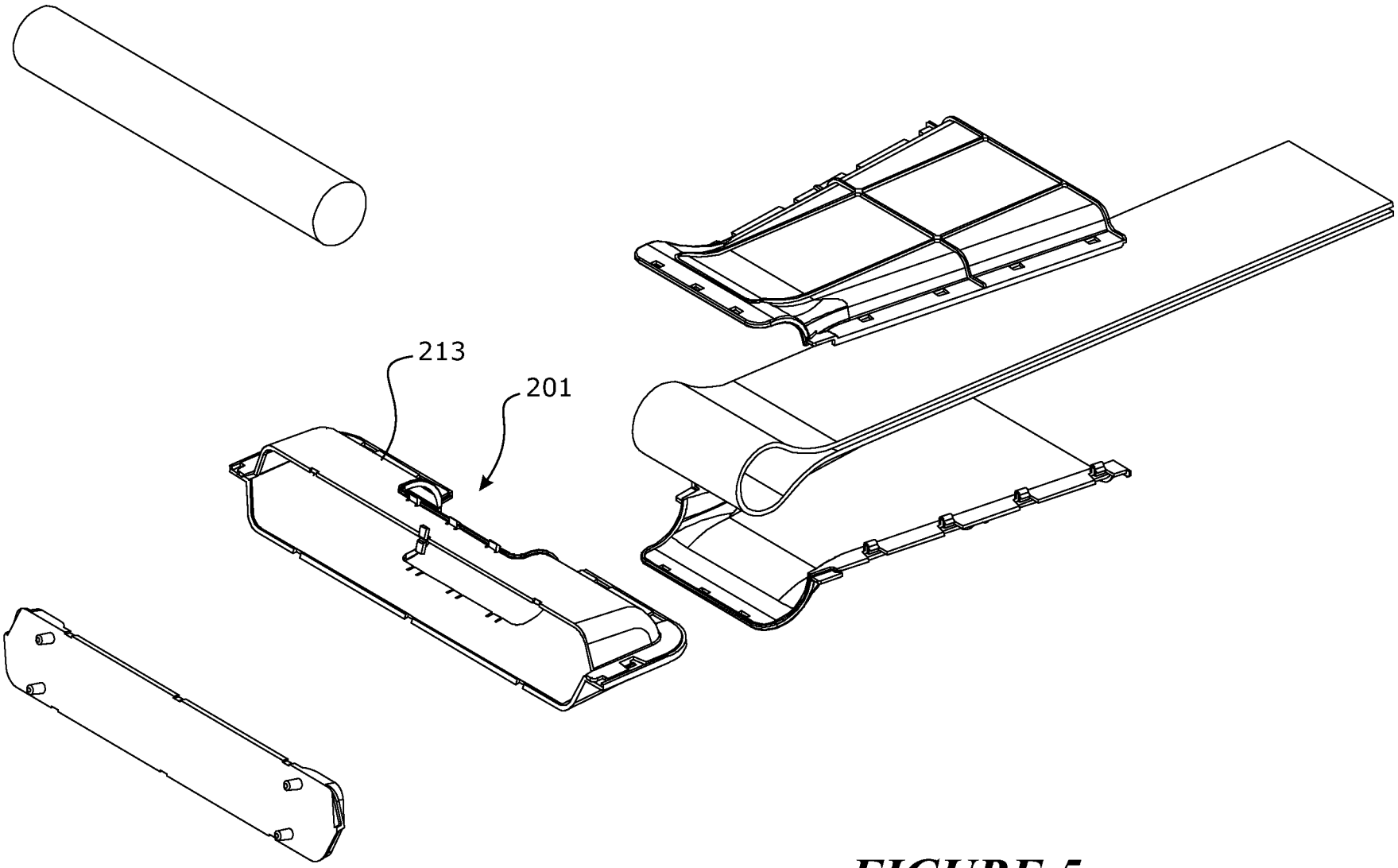
FIG. 5 shows a front perspective view of a pin, strap, end cap and exploded tail section.
Figure 6:
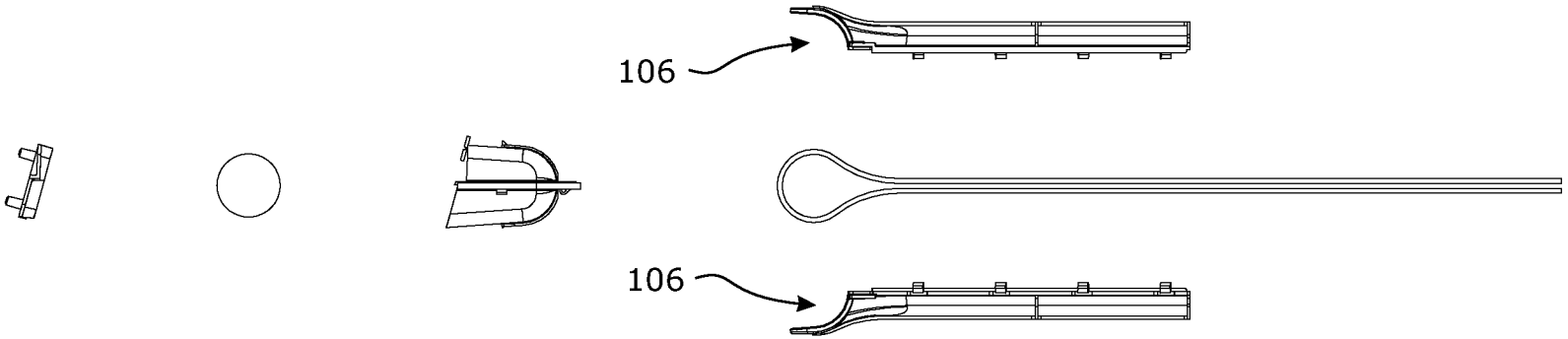
FIG. 6 shows a side view of FIG. 5.

In some embodiments, the head section 200 is formed separately from the tail section and is assembled to the tail section 100 to form the void former 1000. The head section 200 comprises an orifice 201 (FIG. 5), which joins the inner volume or recess 214 of the head section 200 to the tail section 100. The tail section 100 comprises complementary jaws 106 as shown in FIG. 6. The jaws 106 are able to secure about the orifice 201 to form a substantially concrete tight seal with the head section 200.

Figure 7:
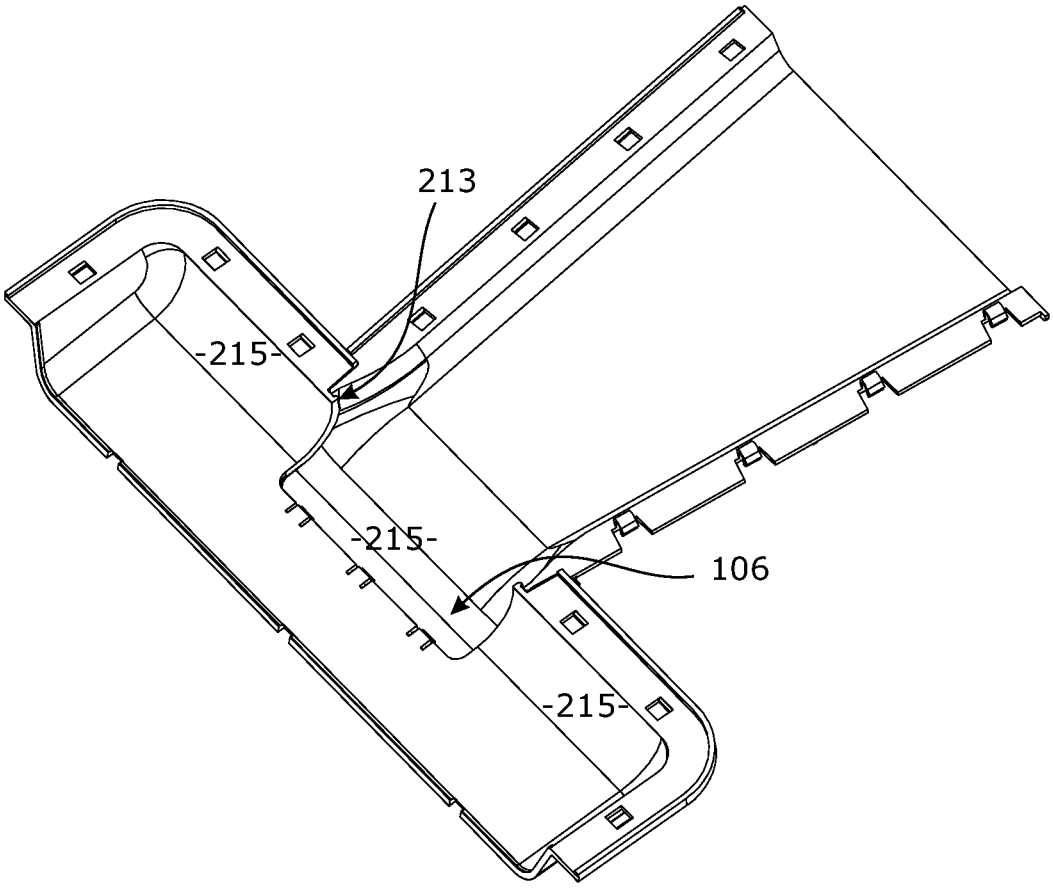
FIG. 7 shows a close-up of one side of a head section and tail section.
Figure 8:
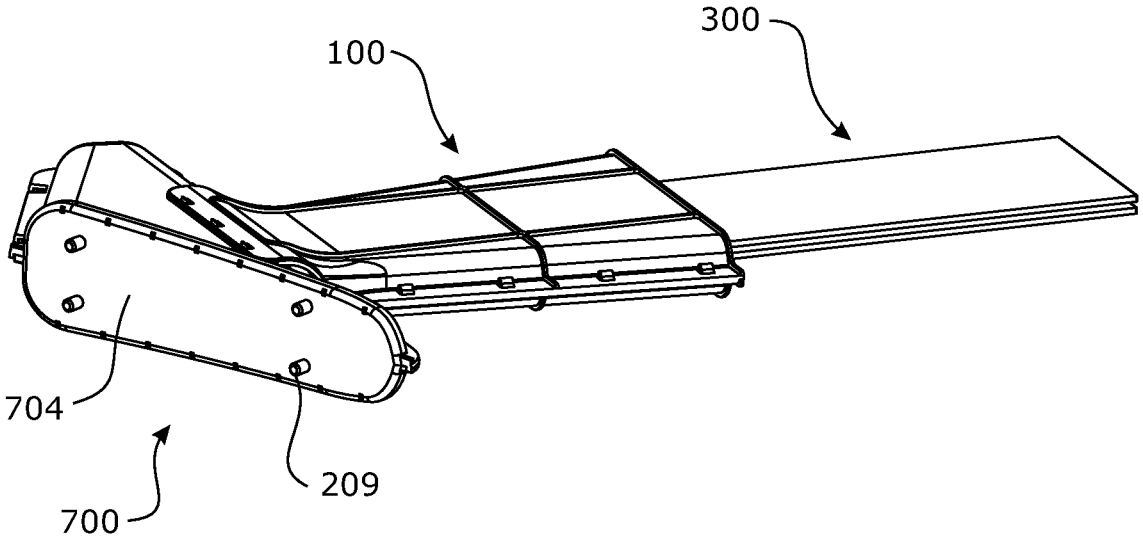
FIG. 8 shows a front perspective view an alternative embodiment of a void former.
Figure 9:
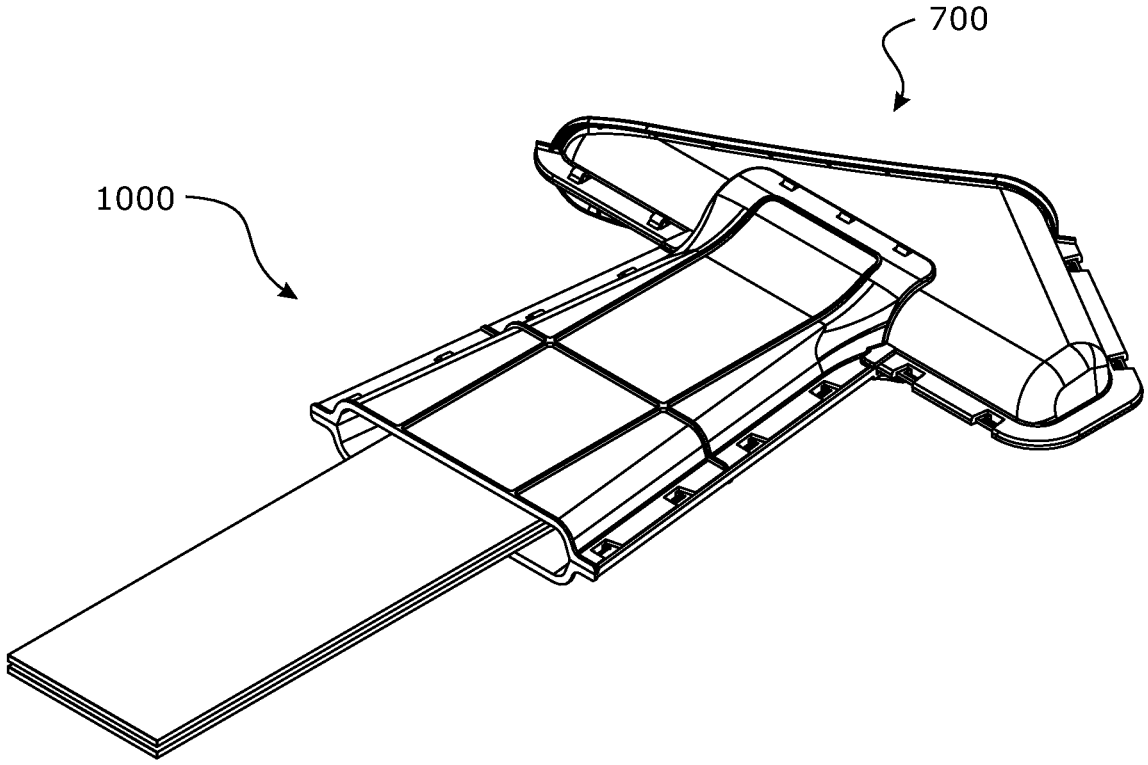
FIG. 9 shows a rear perspective view of FIG. 8.
Figure 21:
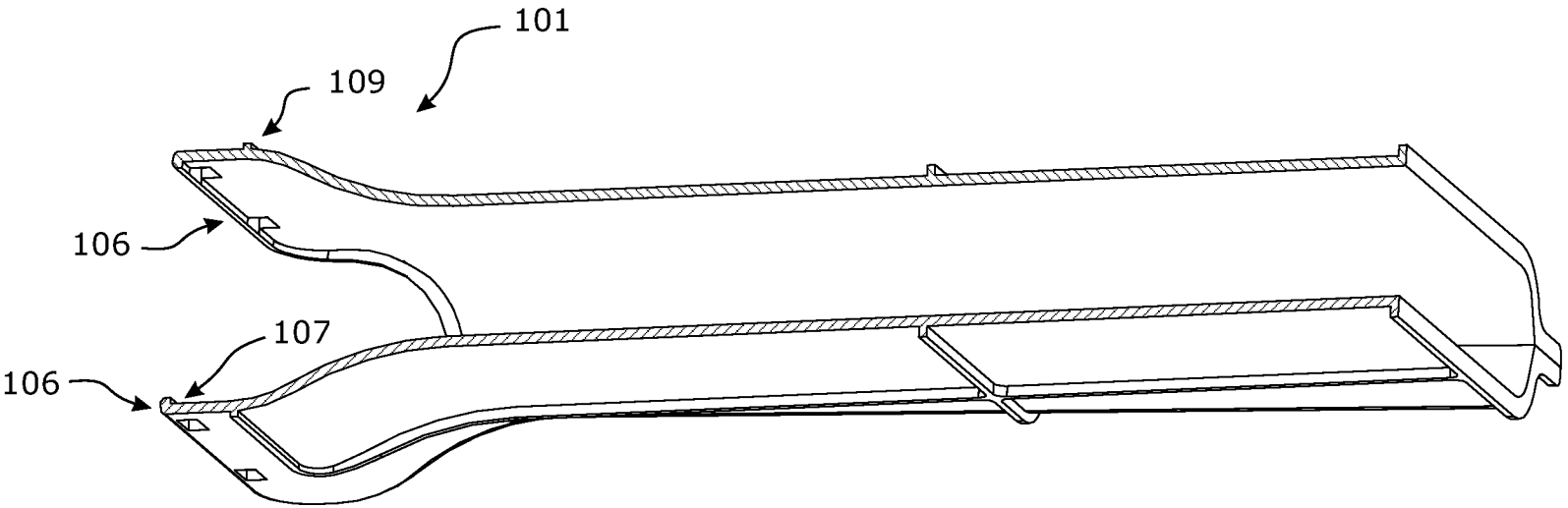
FIG. 21 shows a cross-section through a tail section highlighting the jaws.

In some embodiments the head section has a lip or raised rim 213 extending around the orifice 201, and the tail section has a complementary lip or raised rim 107 extending around the exit or outlet 105 of the tail section. The jaws in the preferred embodiment comprise raised rim 107 which fit about complementary raised rim 213 on the head section as shown in FIGS. 7, 8 and 21. With the tail section and head section fitted together the raised rims 213, 107 of the head and tail sections fit over one another to form a tortuous route or labyrinth type seal between the head section and the tail section of the void former to prevent ingress of concrete into the void.

Preferably the jaws form a semicircular shape to be complementary with a rear face of the head section and said pin. In some embodiments the jaws together with the head section define the recess 214 for receiving the pin 400. The head section 200 and jaws 106 of the tail section 100 together form a recess 214 or cavity for receiving the pin 400. The conduit of the tail section at the exit end of the tail section has a cross sectional area that is smaller than an area of the orifice of the head section. The jaws extend outwards from the exit end of the conduit to cover over the orifice of the head section. In some embodiments the jaws may form the entire rear face of the head section. In alternative embodiments the head section may comprise a male plug that fits within the conduit formed by the tail section.

In some embodiments the tail section may be formed as a single unitary moulded component, with jaws at the second end to secure the tail section to the head section and cover the orifice of the head section. The jaws and the head section together form the recess to operationally accept the loop of the strap extending from the tail section and the locking pin.

Tail Section

The tail section 100 is composed of a first part 101 and a second part 102. Preferably, the first part 101 and the second part 102 are substantially identical in structure. In a preferred embodiment the first and second parts are identical (e.g. formed in the same mould). Preferably, the first part 101 and the second part 102 are able to lie flat against each other when the outside surface of one of the first and second parts is laid adjacent to or against the inside surface of the other one of the first and second parts. This arrangement allows the first part and the second part to be stackable in a space efficient manner, for improved distributed and storage in a flat pack type manner. The parts may be nested together, one inside the other. The first part 101 and second part 102 are interchangeable with each other when forming a tail section 100. Preferably each of the first and second parts forms a half of the tail section.

The first part 101 and second part 102 are joined and secured together by a fastening system 110. Preferably, this fastening system is a hole and barb type arrangement. However, other embodiments of securing the first part and second part together are envisaged. In some embodiments, this may be a hole 111 and a U-shaped member 112 snap fit type system. Preferably the parts are fitted together in a snap fit type arrangement.

In further embodiments, the tail section 100 may be formed of one integral part. In one embodiment, the tail section is formed of two parts hinged together.

The tail section 100 and the head section 200 may comprise ribs 114 to increase the structural rigidity of the respective section, as shown in FIG. 8.

Head Section

In some embodiments, the head section is manufactured as a single component. In some embodiments the head section 200 is a single component comprising a first part 202, a second part 203 and an end cap 204. The first part, second part and end cap are integrally formed as a single component. After manufacture of the head section 200, the first part, second part and end cap are folded so the first part 202 and the second part 203 fold about the end cap 204. Between the first part 202 and the end cap 204, there may be hinges 206 allowing relative bending between the first part and the end cap. Similar hinges 206 are also present between the second part 202 and the end cap 204. The hinges may be live hinges integrally formed with the first and second parts and the end cap. The moulded head section component may be moulded in a flat configuration with the first part, end cap and second part arranged in a planar configuration, to be subsequently folded to form the head section with integral end cap. For example a flat configuration prior to folding is illustrated in FIG. 16. When in a flat or nonoperational configuration, the head section may be stacked in a flat and/or nested configuration with other head sections. Thus the head sections are preferably stackable in a space efficient manner, for improved distributed and storage in a flat pack type manner. The parts may be nested together, one inside the other.

Figure 17:
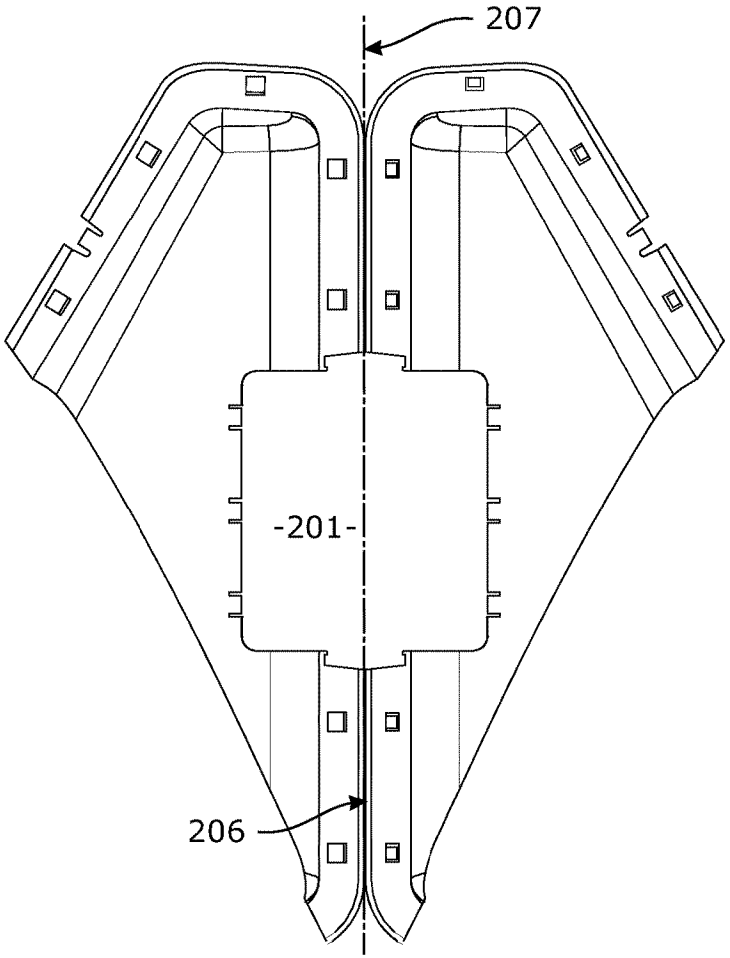
FIG. 17 shows a top view of an alternative angled head section folded out.
Figure 18:
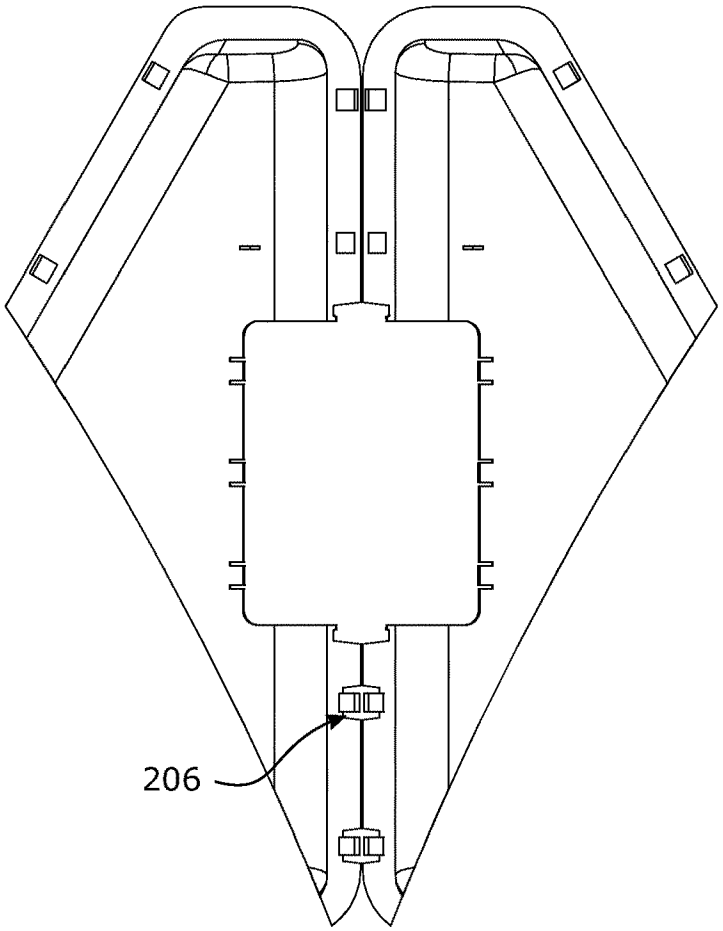
FIG. 18 shows a top view of another alternative angled head section folded out.

Alternatively hinges 206 may be present between the first and second part as shown in FIG. 18 when there is no end cap present. FIGS. 16-19 show different embodiments of the head section shape in an unfolded (flat) state, and different manufacturing styles. It is envisaged a person skilled in the art can design other embodiments within the scope of the invention.

In other embodiments, the first part and second part may be hinged together at the rearward end, at the orifice forming side, and a separate end cap may be attached as shown in FIG. 18.

In a preferred embodiment, the void former comprises a head section formed as a single component as described above, and two identical tail section parts. Thus, for casting blocks, a supply of only two component parts is necessary, a supply of head section parts supplied in a flat packed configuration, and a supply of a tail section parts supplied in a flat packed configuration. To assemble a void former two tail section parts are fitted together to from the tail section, and the head component is folded from the flat configuration to an in use configuration, and assembled to the tail section. This particular form of the invention provides a significant advantage in that the parts for forming many formers can be provided in a space efficient manner and a supply of only two different parts is required.

Preferably, the head section 200 is generally symmetrical about at least one axis 207 as shown in FIGS. 17 and 18. In other embodiments, the head section may be generally symmetrical about two axes 207, 208 as shown in FIG. 16. Generally symmetrical means the overall form of the head section is symmetrical, with differences only in detailed features such as male/female clip details for holding the two parts of the head section together in use.

Preferably, the head section has a rearward face 215 which has a complementary fit to the pin 400 as shown in FIG. 7. The rearward face 215 may be formed of both a rearward face of the head section as well as the tail section. In some embodiments, the jaws 106 of the tail section are substantially contiguous with the rear face of the head section.

In some embodiments the head section comprises a first and second part. In some embodiments, the first head section part and the second head section part are able to lie flat against each other when the outside surface of one is laid adjacent to or against the inside surface of the other. This arrangement allows the first part and the second part to be stackable in a space efficient manner, for improved distributed and storage in a flat pack type manner. The parts may be nested together, one inside the other. The first part and second part may be interchangeable with each other when forming a head section. In some embodiments the first and second head section parts are identical, e.g. formed from the same mould.

Preferably, the void former 1000 is composed of a plastic material. In other embodiments, the void former is composed of a metal material. Alternatively, the void former is composed of fibreglass.

One Piece Foldable Void Former

As described above, in some embodiments the head section comprising a first part 202, second part 203 and end cap 204 are integrally formed as a single component, to be folded from a flat non-operational configuration to an operational configuration. Furthermore, in some embodiments the first part 101 of the tail section is integrally formed with the first part 202 of the head section, and the second part 102 of the tail section is integrally formed with the second part 203 of the head section, so that the void former is manufactured as a single foldable component. Such an embodiment may be preferred from a usability point of view as the former is prepared by folding from a single part only, without the requirement to attach the tail section to the head section. However, to manufacture the void former as a single foldable component requires a larger die/mould for moulding the void former in the flat configuration, and so capital costs may be larger for making the dies/moulds.

Alternative Head Sections

Figure 10:
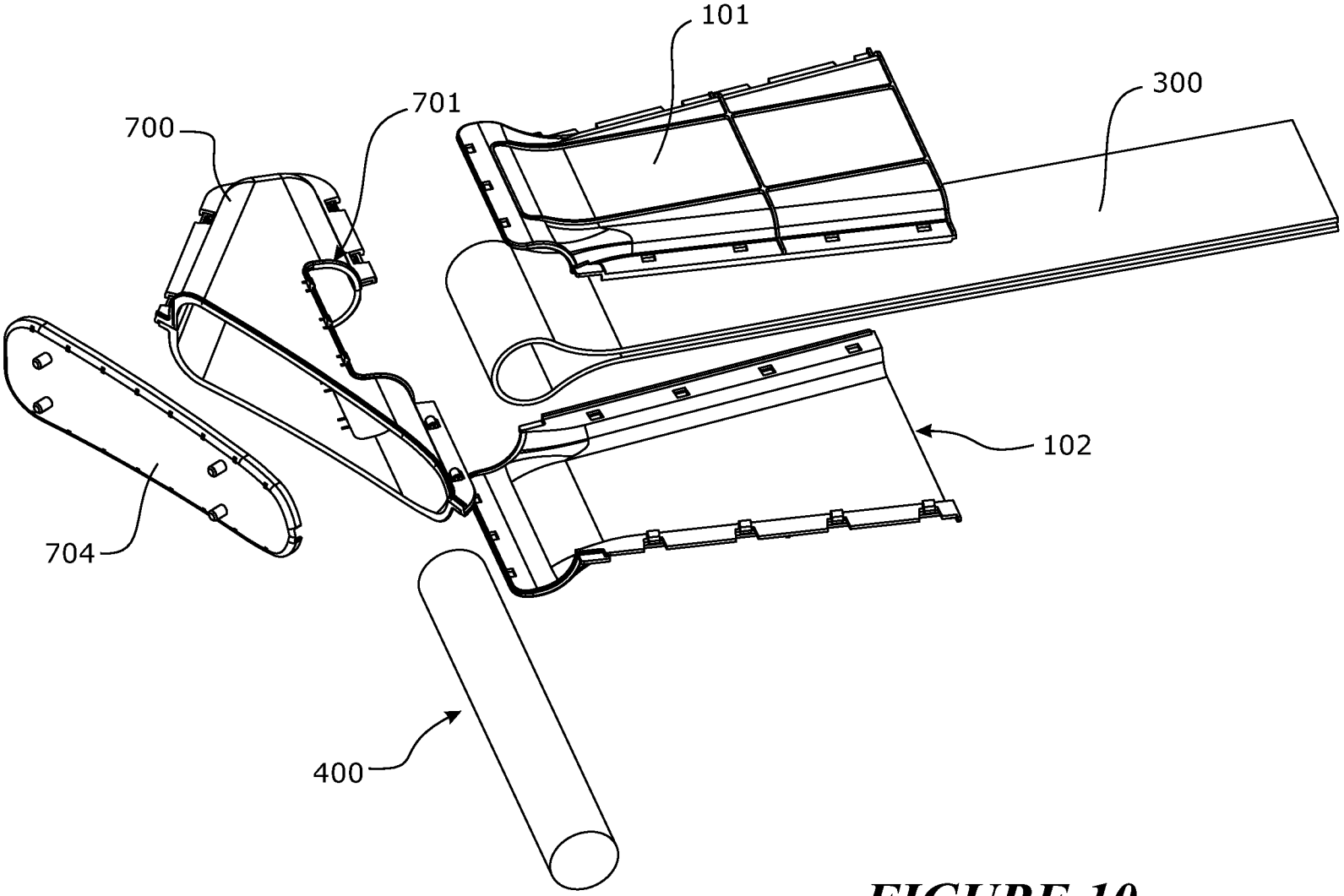
FIG. 10 shows an exploded view of FIG. 8.

In some embodiments, the tail section 100 may be common to a number of different void formers 100. A number of different head sections may be able to be optionally fitted with the tail section 100. A particular head section may be chosen depending on the location of the void within a block, and/or the shape of the second face 503 which the head section protrudes into, or lies against. For example, in FIG. 12 the void 801 has an angled head section 700, as shown in FIG. 10, to complement the shape of the angled forward facing face 503 of the block 500, whereas void 802 has a straighter head section 200 to complement the shape in another location or face 503 of the block 500. The void former arrangements shown in FIG. 12 may be described as 'straight' void formers, as they form voids that have a head section at the same or similar elevation in the wall as the entry of the tail section. In other words, in a straight void former the pin recess 214 is arranged approximately at the same elevation as the entry 104 of the void former, so that the strap 300 generally extends in a straight line from the head section through the tail section.

Figure 15:
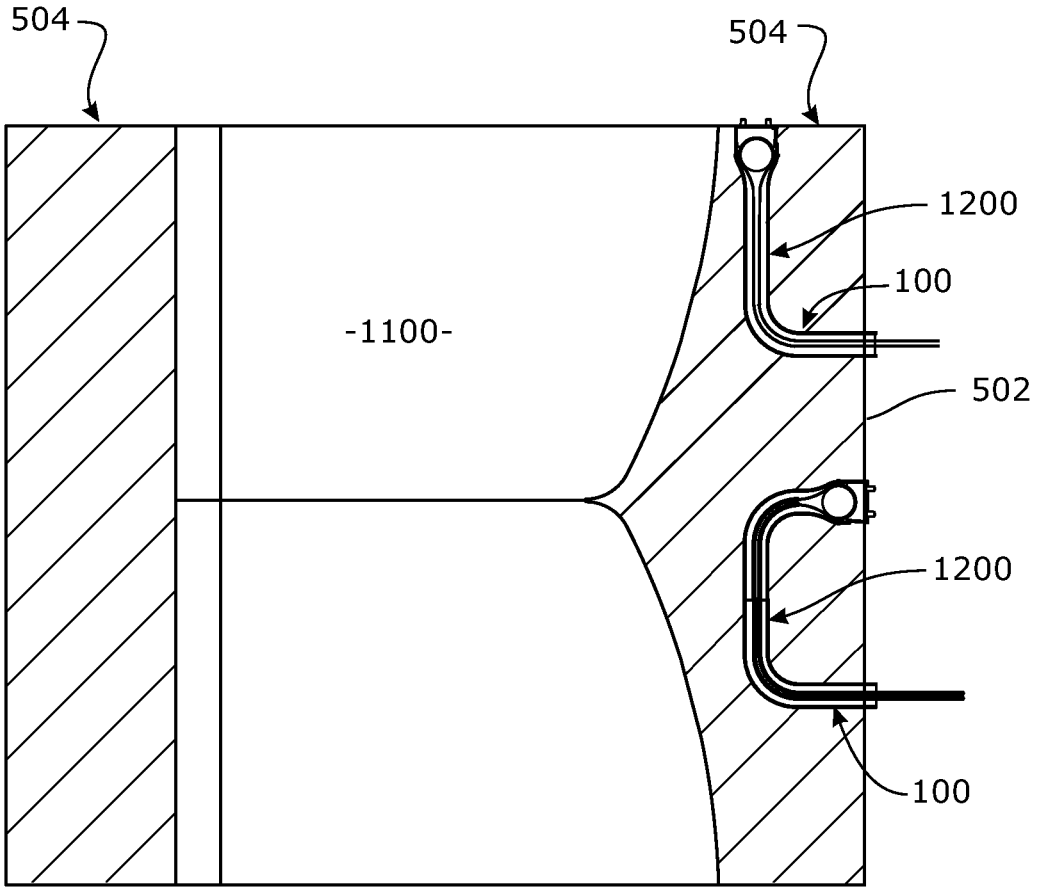
FIG. 15 shows a cross-section of a block with two alternative void formers.

Examples of interchangeable heads are shown in FIGS. 1, 8 and 15. FIG. 10 shows the angled head 700 exploded into its separate parts. In this embodiment the end cap 704 is not integrally formed with the first part 701 and second part 702 of the head section 700.

Figure 20:
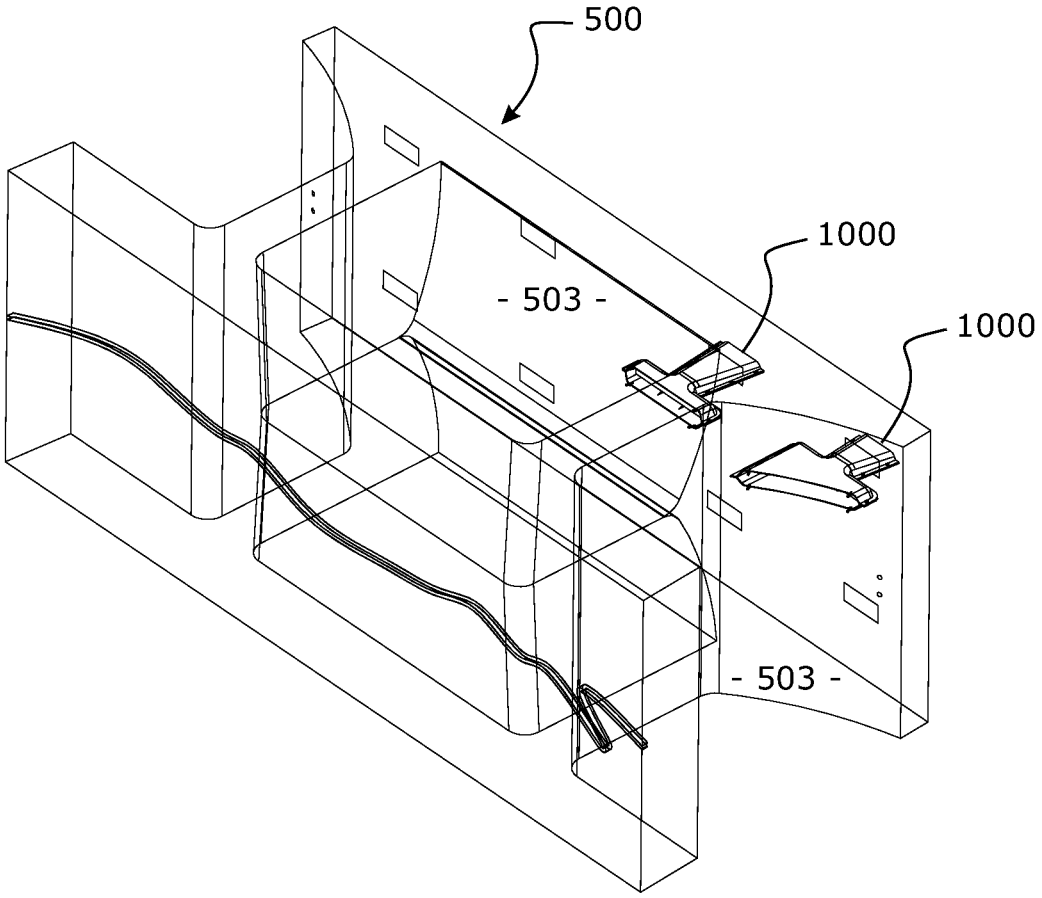
FIG. 20 shows a top perspective view of a block shown transparent to show void formers with different head sections sections.

It is envisaged that many different shaped heads are possible to fit many different shaped block faces. It is preferred that the tail section 100 is able to fit these different type shaped heads, so that a single tail section may be provided to be utilised in many different configurations of void former. Head sections located in the block are shown in FIG. 20 and alternative embodiments in FIG. 15 described below.

The similar tail section 100 allows for ease of manufacturing and ordering parts when designing void formers for different shaped blocks, and installing the void formers in moulds for casting blocks.

In alternative embodiments shown in FIG. 15, the tail section 100 is joined to an upturned head section 900. The upturned head section 900 is configured to direct the strap from the rearward face 502 to a top face 504 of the block. This type of void former may be used where no intermediate hollowing section 1100 is formed within the block. Furthermore, it may be used where the front of the retaining wall needs to be clean and flush and not show any strapping or pins. This is achieved by the strap being directed to the top face 504 where a pin 400 can be inserted into a strap loop 301. The invention is installed in a similar way as previously described. However, the pins are inserted from the top face and not from the front or forward facing face of the block.

The upturned head section comprises a head portion providing a recess for receiving a pin, as described earlier, and a conduit portion for directing the strap 300 from the tail section to the head portion of the head section.

Where the top of the block is perpendicular to the rear face of the block, the upturned head section is preferably formed with a 90 degree angle conduit portion, so the strap may extend through the void from the rear face to the top face, with the strap extending from the rear face of the block in a horizontal plane. In other embodiments, the pin may be arranged at a face that is not perpendicular to the rear face, in which case the upturned head section may comprise an angle other than 90 degrees. For example the upturned head section may comprise an angle so that void former comprises a conduit with a bend angle of 45 degrees to 135 degrees. In some embodiments the head section is configured to provide a void former together with the tail section with a conduit bend angle of 45 to 135 degrees, or 50 to 130 degrees, or 55 to 125 degrees, or 60 to 120 degrees, or 65 to 115 degrees, or 70 to 110 degrees, or 75 to 105 degrees, or 80 to 100 degrees, or 85 to 95 degrees, or about 90 degrees. The void former comprising the tail section and an upturned head section with a conduit bend angle of 45 degrees to 135 degrees may be described as an 'L-shaped conduit' void former or an 'angled-conduit' void former. Preferably the bend is a curved bend. Preferably the bend has a radius of curvature. Preferably the radius of curvature to a centre line of the conduit is 20 mm to 120 mm, or about 20 mm to 80 mm, or about 20 mm to 60 mm, or about 30 mm to 50 mm, or about 40 mm.

In another embodiment shown in FIG. 15, the head section 100 may be joined to a turnback head 1200. The turnback head 1200 turns the direction of the strap 180 degrees back towards the rear face 502 from which it entered. The tail section and turnback head section together form a 'U-shaped' void former. The U-shaped former is configured so that the conduit entry 104 and the head section recess for receiving the pin can both be positioned in a rear face of the block. Or in other words, the face in which the conduit opening 104 is arranged and the face in which the head section is arranged are substantially continuous (e.g. the same face of the block). Again, this is another embodiment used where the design of the block calls for it—e.g. where there may not be a hollow 1100 in the block, or the ability to direct the strap to a forward facing face of the block. A common tail section 100 is able to be used interchangeably with the turnback head 1200, the upturned head section 900 and straight through head sections 200, 700.

In some embodiments, void former comprising the tail and head sections may be formed as a single unitary moulded component. For example, in relation to the L-shaped void former above, the void former may be a single moulded component to have a conduit section for accepting the strap 300 from a first end and with the head section integrally formed with the conduit section at a second end of the conduit section. The conduit section comprises the bend (e.g. 90 degrees), such that the strap extends substantially horizontally from the conduit section at the first face (e.g. rear face) of the block and with the pin at the second face (e.g. a top face) of the block that is at an angle to the first face. Preferably the angle of the bend in the conduit section is the same or similar to the angle between the first and section faces, e.g. 90 degrees for a square or rectangular block. In some embodiments the first face and the second face of the block are outside faces of the block, e.g. the rear face and the top face, or the rear face and the bottom face.

Figure 31:
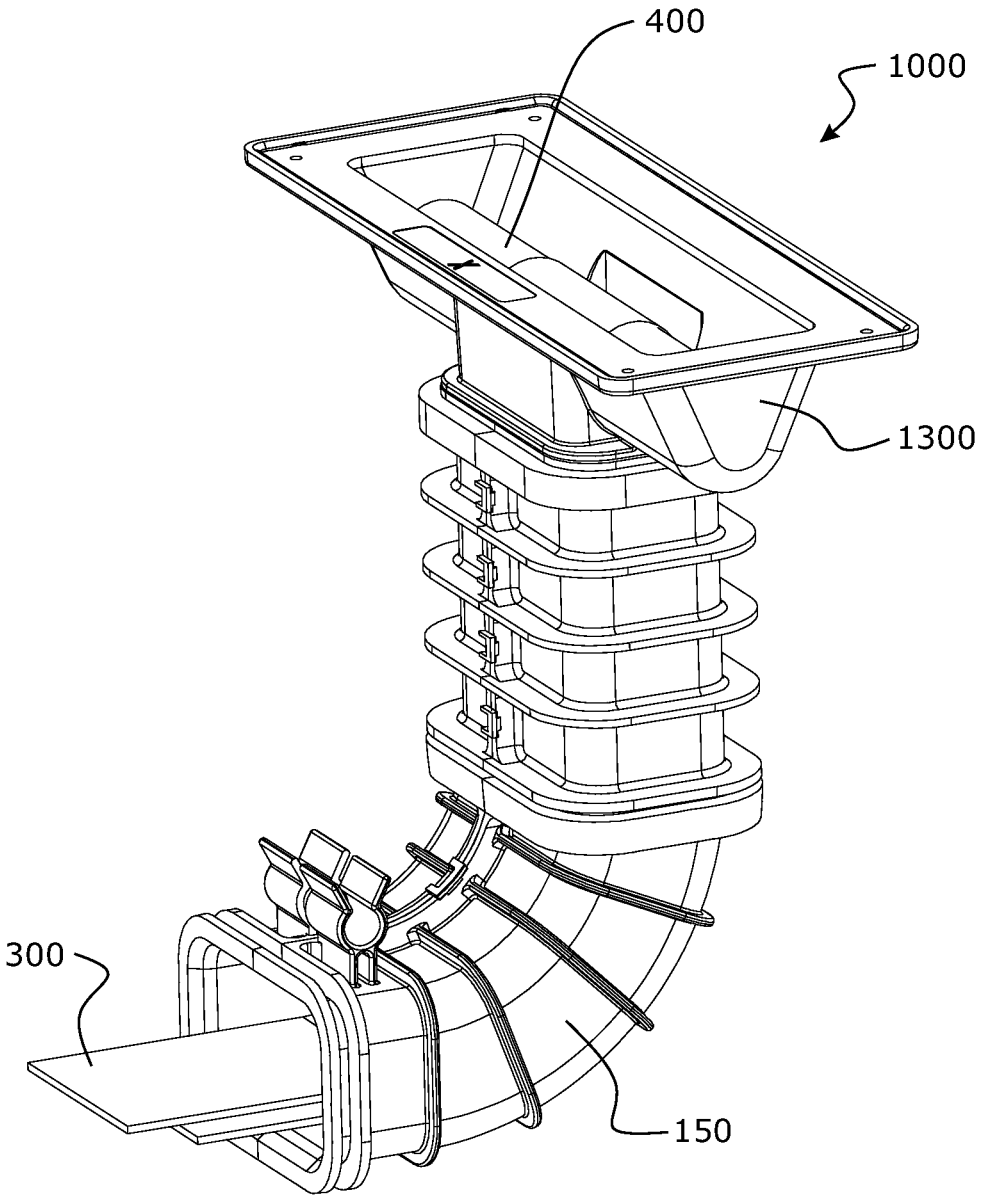
FIG. 31 shows perspective view of another void former.

In a further example, an L shaped void former may comprise a head section such as head section 200 and a tail section forming a conduit as previously described, wherein the tail second includes a 90 degree bend. The conduit with 90 degree bend provides for the strap to extend through the void from the rear face to the top face of the block, with the strap extending from the rear face of the block in a horizontal plane and with the pin located at the top face of the block. In other embodiments, the pin may be arranged at a face that is not perpendicular to the rear face, in which case the tail section may comprise an angle other than 90 degrees. For example the tail section may comprise an angle so that void former comprises a conduit with a bend angle of 45 degrees to 135 degrees, or other angle ranges for an 'L' shaped former described earlier. A further example L-shaped former is shown in FIG. 31, comprising a head section 1300 and a tail section 150 forming a conduit with a 90 degree bend.

Moulded in Pin

With reference to FIGS. 24 to 30, in some embodiments, a void former 1000 may comprise a head section 600 adapted to receive the pin 400 with ends 401, 402 of the pin extending externally from the head section 600. With ends of the pin extending from the head section, end portions 401, 402 of the pin become embedded directly in the cast block 500, while a middle portion of the pin located inside the recess of the void former contacts the strap 300. The head section supports the pin so that the recess 214 of the head section provides a gap 215 (FIGS. 29 and 30) around the pin between the pin 400 and the head section 600 so that the loop of the strap can locate around the circumference of the pin. In the illustrated embodiment the head section 600 is attached to the tail section 100 in the same way as described in previous embodiments. Alternatively the head section 600 and tail section 100 may be integrally formed.

Figure 29:
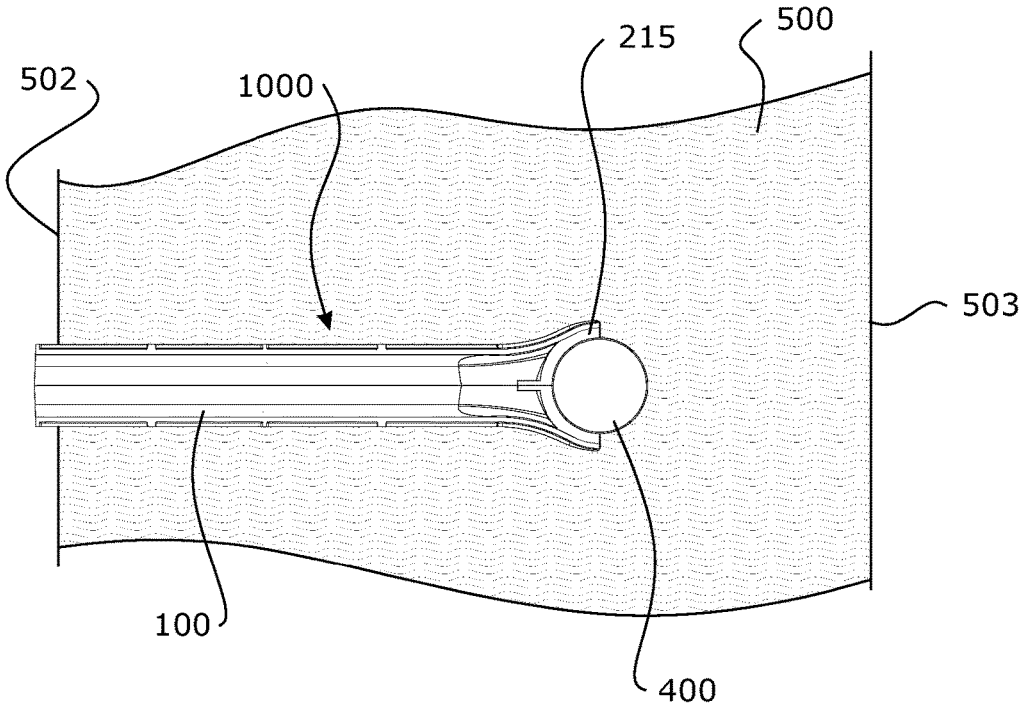
FIG. 29 shows a cross section view on a line I-I in FIG. 28 and with the void former and pin embedded in a cast block, with only a portion of the block shown.
Figure 30:
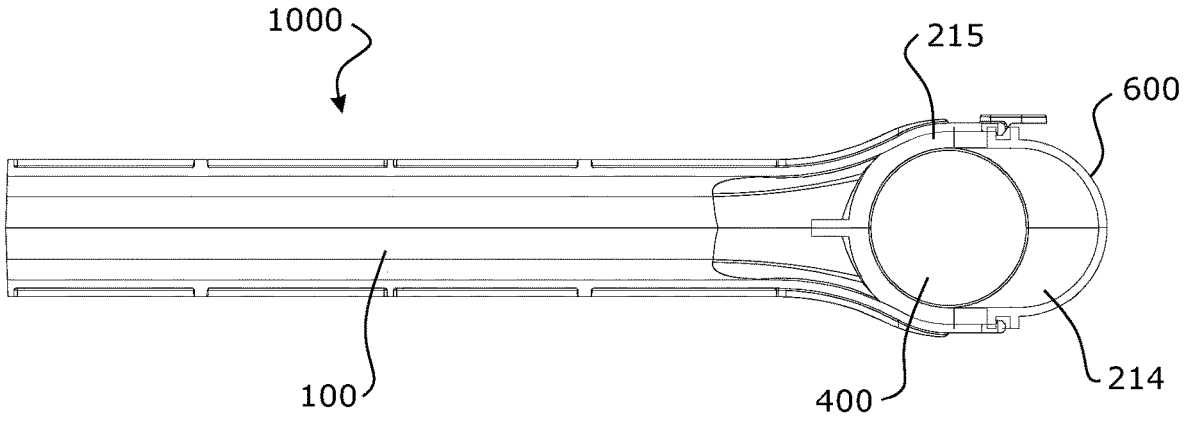
FIG. 30 shows a cross section view on a line II-II in FIG. 28.

The head section comprises a first aperture 604 at a first side and a second aperture 605 at a second side. Ends of the pin extend from the first and second apertures to be embedded directly in material forming the cast block 500, as shown in FIG. 29, which shows an end of the tail second extending from a rear facing face 502 of the block and with the former 600 rearward from a front facing face 503 of the block. Preferably each of the first and second sides of the head section forms a seal about a circumference of the pin 400 to limit or prevent egress of material of the cast block entering the void during a casting process when casting the block. In some embodiments the head section comprises a first tubular portion 606 at the first side of the block and a second tubular portion 607 at the second side of the block. The first and second tubular portions form the first and second apertures 604, 605. The tubular portions form the seal to prevent or limit egress of material into the void former. For example the tubular portions may clamp firmly around the pin 400, or may have a sufficient length and with a sufficiently small gap between the pin and the tubular portion to prevent or limit the amount of egress of material. Thus a seal is not necessarily a tight seal but may be somewhat loose yet have a sufficiently length or difficult flow path that the material forming the cast block is at least limited from entering the void former. The pin is supported by the apertures or the tubular portions of the head section.

In some embodiments a range of head sections may be provided for use with a range of different pin diameters. For example three different head sections may be provided, to fit three different pin diameters of 25 mm, 32 mm and 38 mm. The first and second apertures or first and section tubular sections of each head section are suitably sized to fit a particular pin diameter. Dimensions of the various heads may be identical but for the diameter of the apertures 604, 605 and tubular portions 606, 607.

In some embodiments the head section 600 comprises a first part 601 and a second part 602, and when assembled the first and second parts clamp or surround the pin 400 so that each side of the head section forms a seal about a circumference of the pin to limit or prevent egress of material of the cast block entering the void during a casting process when casting the block. In some embodiments, with the head section 600 attached to the tail section the tail section 100 holds the first and second parts together. For example, as described in previous embodiments, the tail section may comprise jaws at the second end of the tail section configured to secure to the head section and cover the orifice 201 of the head section 600. The jaws receive the head section to hold the two parts of the head section together. The jaws cover the orifice so that the jaws and the head section together form the recess 214, as described in earlier embodiments. The two parts 601, 602 of the head section may be hinged together. For example via a hinge or hinges (e.g. like hinges 206 shown in FIG. 16) located along an edge 609 of the head section distal from the orifice 201.

In some embodiments, the tail section comprises a first part 101 and a second part 102. In some embodiments, the tail section first part 101 and the head section first part 601 are integrally formed, and the tail section second part 102 and the head section second part 602 are integrally formed. In other words, in some embodiments, the void former comprises a first part and a second part that may be assembled together. Preferably the two parts are each a half of the former, the two parts joining on a centreline of the former when assembled. The former comprises two parts so that the head section can be assembled about a pin with ends of the pin extending from the head section. This arrangement is particularly useful to allow for the void former to be assembled to a pin that is prearranged in a mould for casting a block, and/or to a very long pin. For example, for a concrete element, reinforcing bar may be prearranged within a concrete element mould. Prior to pouring the concrete element, void formers may be located in the mould and assembled about a reinforcing bar. Once the formers are assembled to reinforcing bar, concrete may be poured into the mould to form the concrete element, the void former providing a void in the concrete element through which a strap may extend to engage about a reinforcing bar embedded in the concrete element. The two parts of the former may be hinged together, for example hinged together about a hinge axis at an edge of the head section. Alternatively the two parts may be hinged together about a hinge axis at the inlet end of the tail section or a hinge axis at any other location along the former.

Pin

The pin 400 may be of any shape and form to fit the head section region 214. Vice versa, the head section region 214 may be of any shape and size to fit the pin 400. Preferably, the pin 400 is of a circular cross-section. However, in other embodiments the pin has a square, rectangular, triangular, oval or other shaped cross-section.

Preferably, the pin 400 is composed of fibreglass. However, it is envisaged that other types of compositions such as metal or plastics may be used.

In one embodiment, the pin has a length of at least 100 mm. Preferably, the pin has a length of at least 150 mm. In some embodiments, the pin has a length of 220 mm. It is envisaged that a person skilled in the art will design a pin and strap to be suitable for the void former, concrete blocks and construction requirements. In some embodiments the pin is reinforcing bar to be embedded in a concrete element The diameter of the pin may be about 30 mm, or about 38 mm or about 1.5 inches. Alternatively, the diameter of the pin is between 10 mm and 80 mm. Preferably, the chamber or rear face 215 of the head section is radially symmetrical. Preferably the rear face 215 is shaped to complement the shape of the pin.

Advantages

The advantages of using a void former that is formed of plastic and a pin which is fibreglass is that all aspects of the invention do not exhibit risks of degradation and corrosion as is such with metal materials. This is important where the system is exposed to coastal environs.

A further advantage of one or more embodiments of the present invention is that the threading of long straps of polymeric material, i.e. the straps, through a closed loop, is difficult and time consuming. A method that allows the bight, loop or apex of strapping to enter into the void and be secured to the concrete without any threading of an end of strapping may be more time efficient.

A further advantage of one or more embodiments of the present invention is that ends of the pin may be directly embedded in the material of the block, to provide a secure engagement between the pin and the block. The strap may contact a portion of the pin that is located within the void former. The strap may slide over the pin when threading the strap through the void former.

A further advantage of one or more embodiments of the present invention is that the former may be applied to pins or elongate members that are prearranged in a mould for casting a block.

The strap may be composed of a polymeric material. In one embodiment, the polymeric strap comprises a strap of a lined or drawn fibres encased in a protective polymeric sheath (not shown). Preferably, the polymeric sheath is composed of PVC polyethylene. The polymeric sheath may be formed by extrusion moulding. The sheath protects the straps if they were to rub against the void former 1000 or concrete.

The width of the strap is less than the width of the conduit 103. The width of the strap may be between 20 and 200 mm. Preferably the width of the strap is between 80 and 100 mm.

Preferably, the void former 1000 or its component parts are moulded, for example from polystyrene, PVC or low-density polyethylene or other engineering polymers.

In some embodiments, the present invention is a cast block comprising one or more of the void formers described above. In some embodiments, the cast blocks may interengage or interlock with each other to strengthen the wall and to distribute the load placed on individual blocks. The facing or wall or blocks are supported against the loads imposed by the ground structure by said straps of polymeric material which are secured to the blocks. In some embodiments, the soil or ground material may be compacted against the rear face 502 of the block so as to apply a movement preventing force to the pin 400.

In some embodiments, the present invention is a method for building a retaining wall from blocks comprising one or more void formers as described above. The method includes laying a course or row of blocks comprising one or more void formers. Before or preferably after laying the row of blocks the method includes folding a strap to form a bight or loop and threading the loop or bight into the void former from the first end of the tail section or conduit section of the void former to position the bight or loop in the head section of the void former. A pin is then inserted through the loop in the recess of the void former. The strap is pulled, preferably tightly, to secure the strap around the pin in the recess. The strap is then laid across earth or ground behind the wall. Preferably a strap is laid through each void in each block of the course or row of blocks. The method includes back filling and compacting earth over the straps extending from the course or row of blocks to the height of the course or row of blocks, and then repeating the process for subsequent courses or rows of said blocks on top of a previous course or row of blocks to achieve a desired wall height.

A further advantage of some aspects of the present invention the entire system may be disassembled in a non-destructive way. The soil is removed, the straps are loosed and the pins 400 are removed from the strap loops 301 and blocks.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

The invention claimed is:

1. A void former to form a void in an earth retaining cast block to locate a strap for a strap stabilised earth structure, the void former forming a void during casting intermediate a first face of the block and a second face of the block, the void former comprising:

a tail section forming a conduit configured to operationally accept a strap from a first end of the tail section, and a head section at a second end of the tail section configured to form a recess open at the second face of the block to operationally accept a loop of the strap extending from the conduit section and a locking pin to extend through the loop and locatable to prevent the strap from being able to pull back through the void former, wherein the tail section comprises a bend, so that the strap extends substantially horizontally from the tail section at the first face of the block and with the pin located at the second face of the block, the second face at an angle to the first face.

2. The void former as claimed in claim 1, wherein the first face is a rearward face of the block and the second face is an upward facing face of the block, the void former configured to have the first end of the conduit section arranged substantially horizontally at the rearward face of the block and the head section at the upward facing face of the block with the recess open at the upward facing face of the block to receive and locate the locking pin at the upward facing face of the block.

3. The void former as claimed in claim 1, wherein the bend comprises an angle of about 45 to 135 degrees.

4. The void former as claimed in claim 1, wherein the cast block comprises a wall front, a rear face, a top face, a hollow section defined by at least one internal face, a side face, and a forward facing face, wherein the hollow section and forward facing face are intermediate to the wall front and the rear face, and wherein the head section of the void former is configured to form a recess open at one of: the wall front, the top face, the side face, the internal face, or the forward facing face.

5. A cast block as claimed in claim 4, wherein the block comprises at least four void formers, or at least six void formers, or at least eight void formers.

6. A retaining wall comprising a cast block as claimed in claim 4.

7. A cast block comprising one or more void formers each forming a void in the block, the one or more void formers as claimed in claim 1.

8. A cast block comprising one or more voids each void being formed by a void former as claim in claim 1.

9. The void former as claimed in claim 1, wherein the second face of the block is substantially perpendicular to the first face of the block.

10. A void former adapted to form a void in an earth retaining cast block to locate a strap for a strap stabilised earth structure, the void former comprising:

a tail section and a head section attached to or integrally formed with the tail section, the tail section forming a conduit configured to operationally accept a strap from a first end, and the head section forming a recess at a second end of the tail section to operationally accept a loop of the strap extending from the second end of the tail section and a locking pin to extend through the loop to prevent the strap from being able to pull back through the void former, the recess comprising a gap between the pin and the head section for the loop of the strap to locate about a circumference of the pin, and wherein the head section is adapted to receive the pin with ends of the pin extending through sides of the head section to be embedded directly in material forming the cast block.

11. A void former to form a void in an earth retaining cast block to locate a strap for a strap stabilised earth structure, the void former comprising:

a tail section and a head section, the tail section forming a conduit to operationally accept a strap from a first end of the tail section, the head section configured to secure to a second end of the tail section and comprises an orifice, the tail section comprising jaws at the second end of the tail section configured to secure to the head section and cover the orifice, the jaws and the head section together forming a recess to operationally accept a loop of the strap extending from the tail section and a locking pin to extend through the loop to prevent the strap from being able to pull back through the void former.

12. The void former as claimed in claim 11, wherein the head section and tail section together provide a labyrinth seal about the orifice to form a substantially concrete tight seal about the orifice.

13. The void former as claimed in claim 12, wherein the head section comprises a raised rim around the orifice, and the tail section comprises a complementary raised rim about an exit of the conduit, the raised rims of the head section and the tail section adapted to fit together to form the substantially concrete-tight seal.

14. The void former as claimed in claim 11, wherein the tail section comprises a first part and a second part, each having complementary features to allow the first and second parts to be secured together to form the conduit, and wherein the first and second parts are configured to be stacked in a flat and/or nested configuration, atop or below one another, when not fitted together to form the conduit.

15. The void former as claimed in claim 14, wherein the head section is configured to be stacked in a flat configuration when in a non-operational configuration, atop or below another said head section.

16. The void former as claimed in claim 14, wherein the head section comprises two head section parts, the first and second head section parts configured to be stacked in a flat and/or nested configuration, atop or below one another, when not fitted together to form the conduit.

17. The void former as claimed in claim 11, wherein the void former comprises an end cap for the head section to prevent ingress of concrete into the void during the casting process.

18. The void former as claimed in claim 17, wherein the end cap comprises features to fit and locate the head section in complementary features of an internal mould wall in which the block is cast.

19. The void former as claimed in claim 11, wherein the head section comprises two side parts, and each side part of the head section comprises a cut-out, when the two side parts of the head section are fastened together the cut outs forming the orifice to communicate with the conduit allowing access into the recess formed by the head section.

20. The void former as claimed in claim 19, wherein the head section comprises a raised rim around the orifice, and the tail section comprises a complementary raised rim about an exit of the conduit, the raised rims of the orifice and the exit adapted to fit together to form a substantially concrete-tight seal.

21. The void former as claimed in claim 11, wherein the cast block comprises a wall front, a rear face, a top face, a hollow section defined by at least one internal face, a side face, and a forward facing face, wherein the hollow section and forward facing face are intermediate to the wall front and the rear face, and wherein the head section of the void former is configured to form a recess open at one of: the wall front, the top face, the side face, the internal face, or the forward facing face.

* * * * *